US006571080B2

(12) United States Patent
Lee et al.

(10) Patent No.: US 6,571,080 B2
(45) Date of Patent: May 27, 2003

(54) FUSING ROLLER ASSEMBLY HAVING WORKING FLUID AND HEATER COIL FOR QUICK HEATING AND LOW POWER CONSUMPTION FOR AN ELECTROPHOTOGRAPHIC IMAGE FORMING APPARATUS AND METHOD OF MAKING THE SAME

(75) Inventors: Kyung-woo Lee, Gyeonggi-do (KR); Tae-gyu Kim, Gyeonggi-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/947,657

(22) Filed: Sep. 7, 2001

(65) Prior Publication Data

US 2002/0118984 A1 Aug. 29, 2002

Related U.S. Application Data

(60) Provisional application No. 60/257,118, filed on Dec. 22, 2000.

(30) Foreign Application Priority Data

Mar. 15, 2001 (KR) ..... 2001-13451

(51) Int. Cl.[7] ..... G03G 15/20

(52) U.S. Cl. ..... 399/330; 219/469; 432/60

(58) Field of Search ..... 399/328, 330, 399/333, 334; 219/216, 469–471; 432/60

(56) References Cited

U.S. PATENT DOCUMENTS

| | | | | |
|---|---|---|---|---|
| 3,677,329 A | * | 7/1972 | Kirkpatrick | |
| 4,091,264 A | * | 5/1978 | Sarcia | 219/469 |
| 4,172,976 A | * | 10/1979 | Namiki et al. | 219/469 |
| 4,284,875 A | | 8/1981 | Namiki et al. | |
| 4,501,482 A | | 2/1985 | Stryjewski | |
| 4,521,095 A | | 6/1985 | Mayer | |
| 4,717,338 A | * | 1/1988 | Cellier | 432/60 |
| 5,276,493 A | | 1/1994 | Hediger et al. | |
| 5,426,495 A | * | 6/1995 | Sawamura et al. | 219/216 X |
| 5,659,866 A | | 8/1997 | Kim | |
| 5,752,150 A | | 5/1998 | Kato et al. | |
| 5,773,793 A | | 6/1998 | Matsuo | |
| 5,804,794 A | | 9/1998 | Matsuo et al. | |
| 6,064,850 A | | 5/2000 | Matsuo et al. | |
| 6,072,156 A | | 6/2000 | Matsuo et al. | |
| 6,072,979 A | | 6/2000 | Hiroaka | |
| 6,091,052 A | | 7/2000 | Matsuo et al. | |

FOREIGN PATENT DOCUMENTS

| | | |
|---|---|---|
| EP | 0 399 376 | 11/1990 |
| EP | 0772100 | 5/1997 |
| JP | 04032885 | 2/1992 |
| JP | 6-175528 | 6/1994 |
| JP | 09197863 | 7/1997 |
| WO | WO98/31194 | 7/1998 |

OTHER PUBLICATIONS

European Search Report No. 01 30 9414.9 dated May 7, 2002.

European Search Report No.01 31 0591.1 dated May 15, 2002.

Korean Intellectual Property Office action dated Jan. 27, 2003, issued by the Korean Industrial Property Office in Applicant's corresponding Korean Priority Application No. 10–2001–0013451 filed on the 15$^{th}$ of Mar. 2001.

* cited by examiner

*Primary Examiner*—William J. Royer
(74) *Attorney, Agent, or Firm*—Robert E. Bushnell, Esq.

(57) ABSTRACT

A structurally improved fusing roller assembly based on a heat pipe principle is provided. The fusing roller assembly includes a fusing roller that serves as a heat pipe, and a resistance heater and/or a halogen lamp inside the fusing roller, so that the surface of the fusing roller can be instantaneously heated up to a target fusing temperature. The fusing roller assembly can be heated up to a target fusing temperature within a shorter period of time without need for a warm-up period and a stand-by period, so that power consumption decreases.

48 Claims, 21 Drawing Sheets

FIG. 6
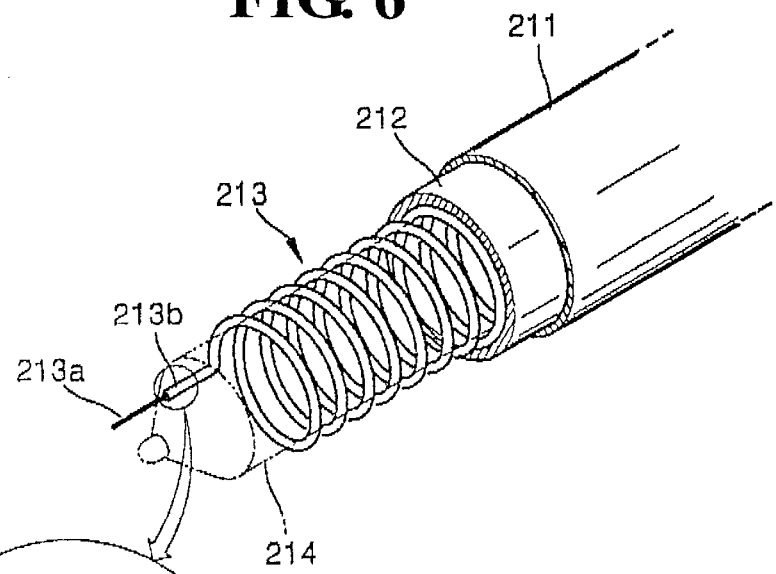
FIG. 6A
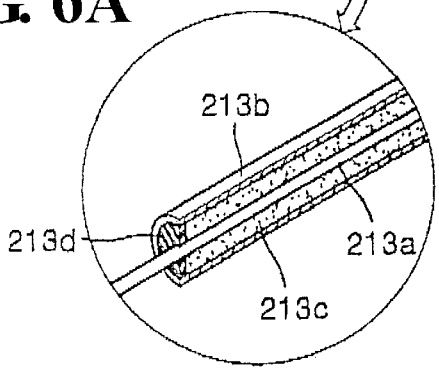
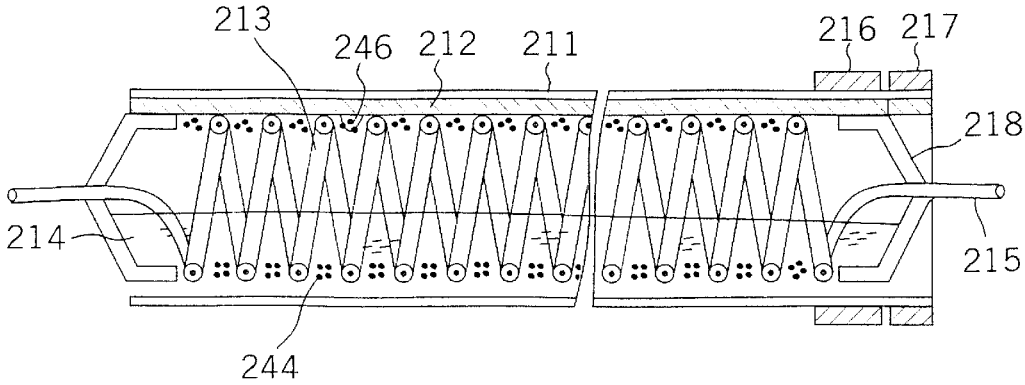
FIG. 7

FUSING ROLLER ASSEMBLY HAVING WORKING FLUID AND HEATER COIL FOR QUICK HEATING AND LOW POWER CONSUMPTION FOR AN ELECTROPHOTOGRAPHIC IMAGE FORMING APPARATUS AND METHOD OF MAKING THE SAME

CLAIM OF PRIORITY

This is application makes reference to, incorporates the same herein, and claims all benefits accruing under 35 U.S.C. §119 from a Korean patent application No. 2001-13451 filed in the Korean Industrial Property Office on Mar. 15, 2001 and a U.S. provisional patent application Serial No. 60/257,118 filed in the U.S. Patent and Trademark Office on Dec. 22, 2000.

BACKGROUND OF THE INVENTION

1. Field of the Invention

The present invention relates to a fusing roller apparatus for an electrophotographic image forming apparatus, and more particularly, to a fusing roller apparatus for an electrophotographic image forming apparatus, which can be instantaneously heated with low power consumption.

2. Description of the Related Art

In a general electrophotographic image forming apparatus such as a copy machine and laser beam printer, as an electrostatic charging roller adjacent to a photoreceptor drum rotates, a photosensitive material coated on the surface of the photoreceptor drum is uniformly charged. The charged photosensitive material is exposed to a laser beam scanned from a laser scanning unit (LSU) so that a latent electrostatic image is formed in a predetermined pattern on the photosensitive material. A developer unit supplies toner to the photosensitive material to develop the latent electrostatic image formed on the photosensitive material into a visible toner image. A predetermined transfer voltage is applied to a transfer roller which is put in contact with the photoreceptor drum at a predetermined force while the photoreceptor drum carries the toner image. In this state, as a print paper is fed in the gap between the transfer roller and the photoreceptor drum, the toner image formed on the photosensitive material is transferred to the print paper. A fixing unit which includes a fusing roller, instantaneously heats the print paper to which the toner image is transferred to fuse and fix the toner image to the print paper. In general, a halogen lamp is used as a heat source for the fixing unit. The halogen lamp is installed inside the fusing roller and heats the surface of the fusing roller to a target temperature with radiant heat.

In a conventional fusing roller apparatus of an electrophotographic image forming apparatus, which uses a halogen lamp as a heat source, the exterior surface of the fusing roller must generate heat; the fusing roller is therefore heated from the inside out by radiant heat from the halogen lamp. A pressure roller is located below the fusing roller. As print paper carrying a toner image in a powder form passes between the fusing roller and the pressure roller, the print paper is hot pressed by a predetermined force and the toner image is fused and fixed to the print paper by the heat and force from the fusing roller and the pressure roller.

A thermistor may be used for detecting and converting the surface temperature of the fusing roller into an electric signal and a thermostat may be used to cut off the power supply to the halogen lamp.

A conventional fusing roller apparatus which employs a halogen lamp as a heat source unnecessarily consumes a large amount of power, and needs a considerably long warm-up period when the image forming apparatus is turned on for image formation. In other words, after the application of power, a standby period follows until the temperature of the fusing roller reaches a target temperature, for example, for a few tens of seconds to a few minutes. We have found that with a conventional fusing roller apparatus, because the fusing roller is heated by radiant heat from the heat source, the rate of heat transfer is low. In particular, compensation for temperature variations due to a drop in the temperature of the fusing roller caused by contact with a print paper is delayed, so that it is difficult to uniformly control the distribution of temperature along the axial length of the fusing roller. Even in a stand-by mode where the operation of the printer is suspended, power must be periodically applied so as to keep the temperature of the fusing roller constant, thereby causing unnecessary power consumption. Also, it takes a considerable amount of time to switch the fusing roller from its stand-by mode to an operating mode for image output, so that the resultant image cannot be rapidly printed.

An alternative design for a conventional fusing roller apparatus employs a heating plate placed in a lower portion of a flexible cylindrical film tube, with a pressure roller mounted underneath the heating plate. The film tube is rotated by a separate rotation unit and is locally heated and deformed at a part between the heating plate and the pressure roller. While this method of locally heating the film tube with a heating plate was thought to be advantageous in terms of low power consumption, it is unsuitable for high-speed printing.

Japanese Patent Application Nos. sho 58-163836 (Sep. 16, 1983); hei 3-107438 (May 13, 1991), hei 3-136478 (Jun. 7, 1991); hei 5-135656 (Jun. 7, 1993); hei 6-296633 (Nov. 30, 1994); hei 6-316435 (Dec. 20, 1994); hei 7-65878 (Mar. 24, 1995); hei 7-105780 (Apr. 28, 1995); hei 7-244029 (Sep. 22, 1995); hei 8-110712 (May 1, 1996); hei 10-27202 (Feb. 9, 1998); hei 10-84137 (Mar. 30, 1998); and hei 10-208635 (Jul. 8, 1998) disclose heat-pipe equipped fusing roller apparatus.

Such fusing roller apparatus using heat-pipes can be instantaneously heated, thereby reducing power consumption. Fusing roller apparatus also have a short period of delay when switching between stand-by and a printing operation. In particular, the fusing roller apparatus disclosed in Japanese Patent Application Nos. hei 5-135656; hei 10-84137; hei 6-29663; and hei 10-208635 employ different types of heat sources at one end of the fusing rollers, that are positioned beyond the fixing areas. The arrangement of the heat source for each of these fusing roller apparatus increases the volume of the fusing roller apparatus and requires complex structures. Thus, there is a need to improve the structural complexity of such fusing roller apparatus.

The fusing roller apparatus disclosed in Japanese Patent Application Nos. sho 58-163836; hei3-107438; hei3-136478; hei6-316435; hei7-65878; hei7-105780; and hei7-244029 have their heat sources located within their fusing rollers, so that there remains a problem attributable to the increased volume of this apparatus described above. A plurality of local heat pipes, however, are installed for each fusing roller, thereby complicating fabrication and manufacture of the fusing roller apparatus. The local arrangement of the heat pipes moreover, causes temperature deviations between heat-pipe contact portions and heat-pipe non-contact portions.

SUMMARY OF THE INVENTION

To solve these and other problems in the art, it is an object of the present invention to provide an electrophotographic image forming apparatus and process.

It is another object to provide an improved fusing roller and fusing process.

It is still another object to provide a fusing roller apparatus for an electrophotographic image forming apparatus, in which local temperature deviation of a fusing roller is sharply reduced, thereby improving overall thermal distribution characteristics.

It is yet another object of the present invention to provide a fusing roller apparatus for an electrophotographic image forming apparatus, which is easy to manufacture and is designed to minimize any increase in the size of the fusing roller apparatus.

It is still another object to provide a fusing roller able to progress from its standby state to its printing state in a shorter period of time.

It is also an object to provide a more energy efficient electrophotolithographic process and apparatus.

To achieve these and other objects of the present invention, in a first embodiment there is provided a fusing process and roller apparatus that may be practiced with a cylindrical fusing roller with both ends sealed; the interior cavity of the fusing roller is evacuated down to a predetermined pressure. The interior cavity of the fusing roller contains a predetermined amount of a working fluid; and a heat-generator is installed in the fusing roller in contact with the working fluid.

A second embodiment of the fusing process and roller apparatus may be practiced with a cylindrical fusing roller that has its axially opposite ends sealed and the interior cavity of the fusing roller is evacuated down to a predetermined pressure. The interior cavity of the fusing roller contains a predetermined amount of a working fluid. A partition divides the inner space of the fusing roller into a plurality of unit spaces. A heat-generator installed in the fusing roller surrounds the partition and is in contact with the working fluid.

For a fusing roller apparatus constructed as either the first or second embodiment of the present invention, it is preferable that the heat-generator is constructed as a spiral-shaped helical coil of a resistance heating element and that both leads of the resistance heating coil extend out from the fusing roller through axially opposite ends of the fusing roller. It is preferable that the heat-generator be arranged helically along and be placed in direct contact with the inner surface of the fusing roller. To enhance the contact force of the heat-generator against the inner wall of the fusing roller, it is preferable that the heat-generator have an outer diameter that is greater than the inner diameter of the interior cavity of the fusing roller so that the heat-generator is elastically compressed in a force fit against the interior cylindrical surface of the fusing roller due to the force created by the differences in diameter. It is preferable that the fusing roller be formed of either copper (Cu) or stainless steel. If the fusing roller is formed of copper, distilled water is preferred as the working fluid. The amount of the liquid phase of the heating medium, that is, the liquid phase of a working fluid contained in the fusing roller, maybe in the range of 5–50% by volume, and preferably with a range of 10–15% by volume, based on the volume of the interior cylindrical cavity of the fusing roller.

For the third embodiment of the fusing roller apparatus, it is preferable that the partition be constructed with a plurality of dividers that are radially arranged.

In a second embodiment of the fusing roller apparatus constructed according to the principles of the present invention, a fusing roller apparatus may be constructed with a cylindrical fusing roller including an outer tube having a first diameter and an inner tube having a second diameter that is smaller than the first diameter coaxially positioned inside the outer tube to form an annular space between the outer tube and the inner tube. The annular space of the fusing roller is evacuated down to a predetermined pressure. A predetermined amount of a working fluid that is smaller than the volume of the annular space formed between the outer tube and the inner tube, is contained within the annular space of the fusing roller. A heat-generator is installed either inside the inner tube or in the annular space.

For the third embodiment of the fusing roller apparatus, it is preferable that the heat-generator be constructed with a first heater installed in the annular space or/and a second heater be installed inside the inner tube. It is preferable that the first heater is a spiral resistance heating coil and that the second heater is a halogen lamp. For the third embodiment of the fusing roller apparatus, it is preferable that the partition be constructed with a plurality of dividers that are radially arranged. It is also preferable that the plurality of partitions divide the annular space into plurality of unit spaces. A fusing roller apparatus constructed as a third embodiment of the present invention may be modified to incorporate one or more of the structural features of the first and second embodiments of the fusing roller apparatus, in accordance with the principles of the present invention.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein:

FIG. 6 is a partial perspective view of the structure of the fusing roller apparatus illustrated by FIG. 5;

FIG. 6A is a partial cut-away cross-sectional detailed view of a resistance heating coil shown in FIG. 6;

FIG. 7 is a cross-sectional view illustrating the inner structure of the fusing roller apparatus shown by FIGS. 5 and 6;

DETAILED DESCRIPTION OF THE INVENTION

Figure 1:
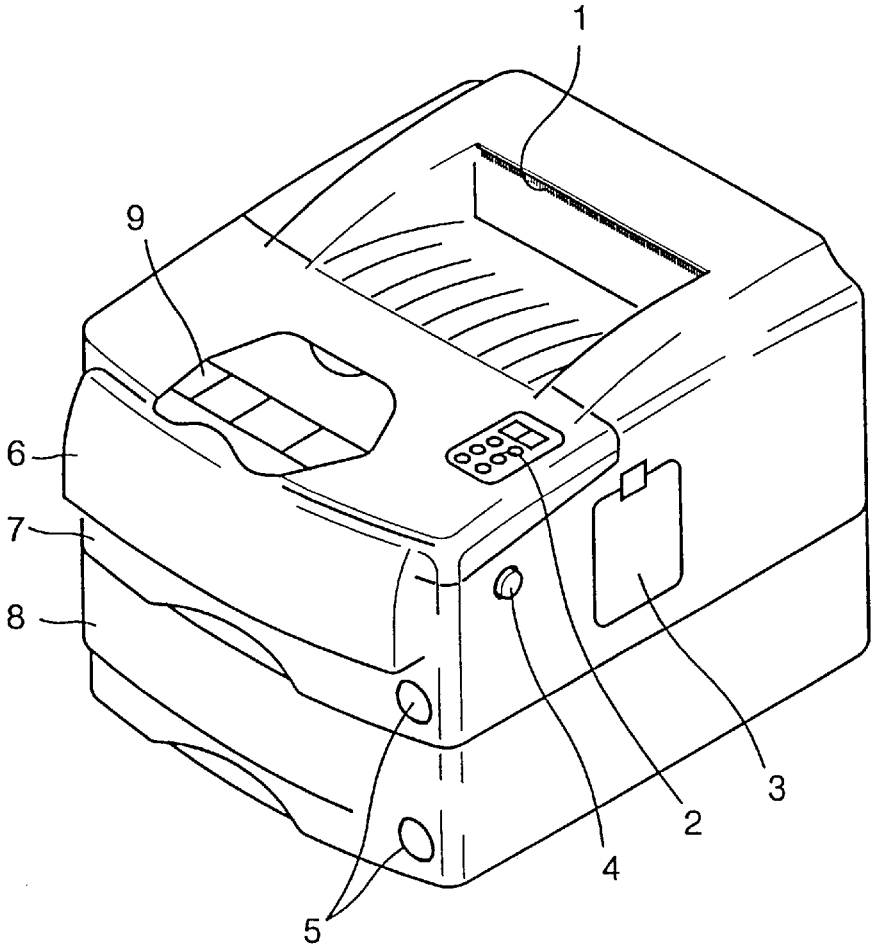
FIG. 1 (PRIOR ART)
FIG. 1 is a perspective view of a general electrophotographic image forming apparatus.

FIG. 1 shows a general electrophotographic image forming apparatus, with an electrophotographic image forming apparatus that includes a paper ejector 1, a keypad 2, a control board cover 3, an upper-cover opening button 4, paper indication windows 5, a multi-purpose paper feed tray 6, a paper cassette 7, an optional cassette 8, and an auxiliary paper support 9.

Figure 2:
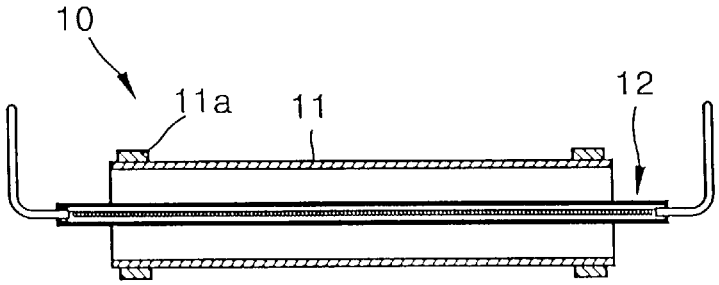
FIG. 2 (PRIOR ART)
FIG. 2 is a sectional view of a conventional fusing roller apparatus of an electrophotographic image forming apparatus.
Figure 3:
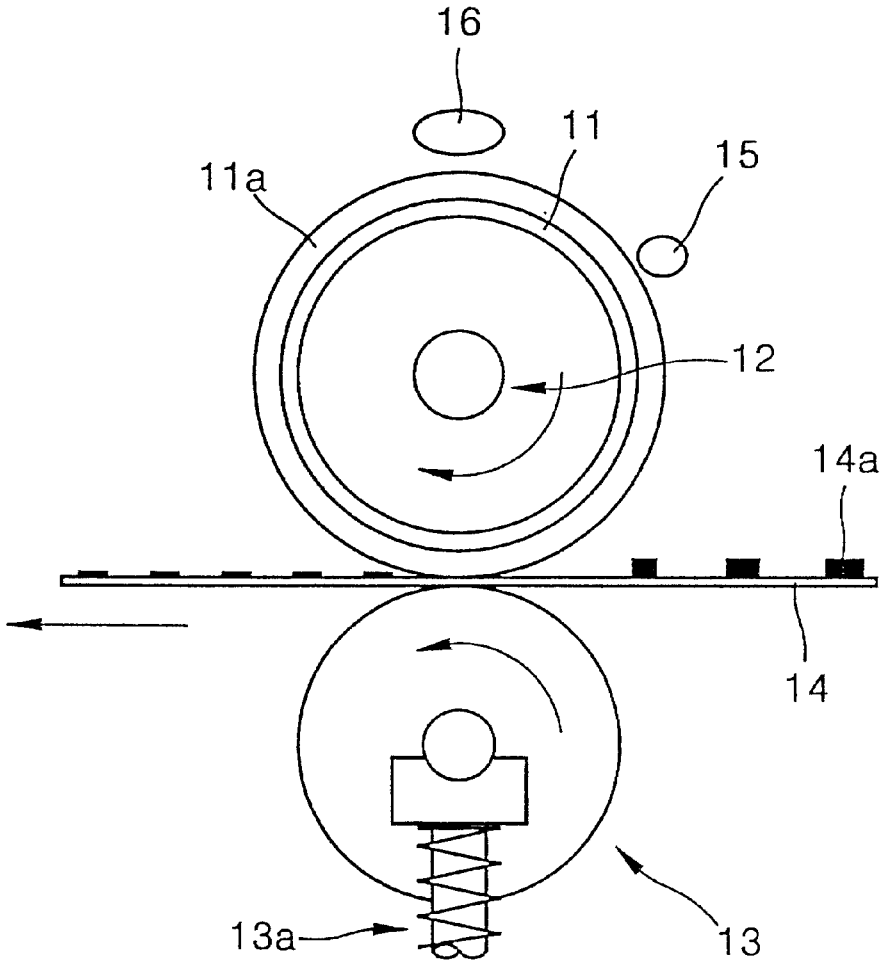
FIG. 3 (PRIOR ART)
FIG. 3 shows the structure of a fixing unit of an electrophotographic image forming apparatus incorporating a conventional fusing roller apparatus.

FIG. 2 is a cross-sectional view of a conventional fusing roller apparatus of an electrophotographic image forming apparatus, which uses a halogen lamp as a heat source. FIG. 3 is a sectional view of the fusing roller of FIG. 2 with the halogen lamp as a heat source and a pressure roller, as used in the conventional electrophotographic image forming apparatus. Referring to FIG. 2, the conventional fusing roller apparatus 10 includes a cylindrical fusing roller 11 and a heat-generator 12, such as a halogen lamp, inside the fusing roller 11. As the exterior surface of fusing roller 11 must generate heat, fusing roller 11 is heated from the inside out by radiant heat from heat-generator 12.

Referring to FIG. 3, a pressure roller 13 is located below the fusing roller 11 having a coated layer 11*a* formed of Teflon. The pressure roller 13 is elastically supported by a spring assembly 13*a* to press a print paper 14 passing between the fusing roller 11 and the pressure roller 13 against the fusing roller 11 by a predetermined force. As the print paper 14 carries a toner image 14*a* in a powder form between the fusing roller 11 and the pressure roller 13, the print paper 14 is hot pressed by a predetermined force. In other words, the toner image 14*a* is fused and fixed to the print paper 14 by the heat and force from the fusing roller 11 and the pressure roller 13.

A thermistor 15 is used for detecting and converting the surface temperature of the fusing roller 11 into an electric signal and a thermostat 16 for cutting off the power supply to the heat-generator 12, such as a halogen lamp, are installed adjacent to the fusing roller 11. When the surface temperature of the fusing roller 11 goes beyond a given threshold value, thermostat 16 interrupts electrical power to heat generator 12. The thermistor 15 detects the surface temperature of the fusing roller 11 and transmits the result of the detection to a controller (not shown) for the printer. The controller controls the power supply to the halogen lamp of heat-generator 12 according to the detected surface temperature of the fusing roller 11 to keep the surface temperature within a given range. The thermostat 16 serves as a thermal protector for the fusing roller 11 and neighboring elements, which operates when the thermistor 15 and the controller fail to control the temperature of the fusing roller 11.

A conventional fusing roller apparatus which employs a halogen lamp as a heat source unnecessarily consumes a large amount of power, and needs a considerably long warm-up period when the image forming apparatus is turned on for image formation. In other words, after the application of power, a standby period is followed until the temperature of the fusing roller 11 reaches a target temperature, for example, for a few tens of seconds to a few minutes. For the conventional fusing roller apparatus 10, because the fusing roller 11 is heated by radiant heat from the heat generator 12, the heat transfer rate is low. In particular, compensation for temperature variations due to a drop in the temperature of the fusing roller 11 caused by contact with a print paper 14 is delayed, so that it is difficult to uniformly control the distribution of temperature of the fusing roller 11. Even in a stand-by mode where the operation of the printer is suspended, power must be periodically applied so as to keep the temperature of the fusing roller 11 constant, thereby causing unnecessary power consumption. Also, it takes a considerable amount of time to switch the stand-by mode to an operating mode for image output, so that the resultant image cannot be rapidly output.

Figure 4:
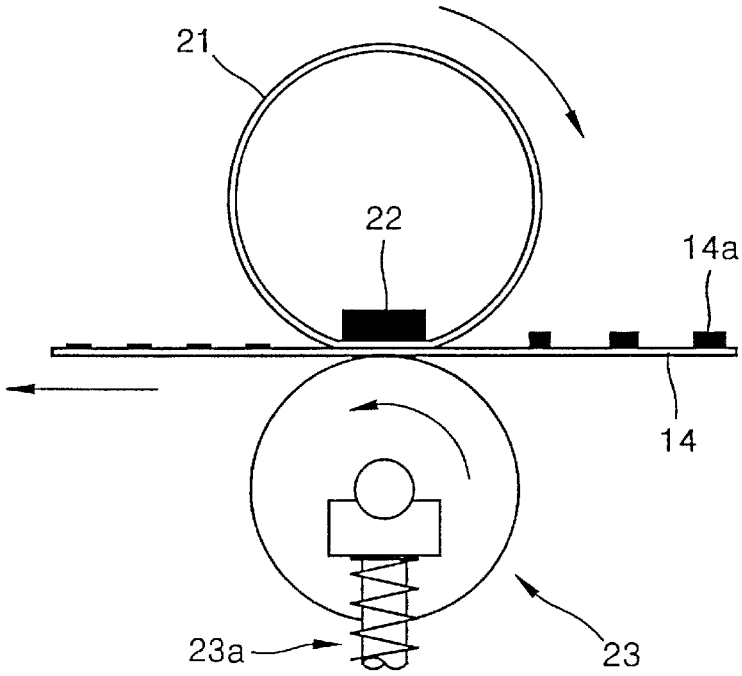
FIG. 4 (PRIOR ART)
FIG. 4 shows the structure of a fixing unit of an electrophotographic image forming apparatus that incorporates a different conventional fusing roller apparatus.

FIG. 4 is a sectional view of a conventional fusing roller apparatus applied to an electrophotographic image forming apparatus. Heating plate 22 is placed in a lower portion of a flexible cylindrical film tube 21, and a pressure roller 23 is mounted underneath the heating plate 22. The film tube 21 is rotated by a separate rotation unit and is locally heated and deformed at a part between the heating plate 22 and the pressure roller 23. This method of locally heating the film tube 21 by the heating plate 22 is advantageous in terms of low power consumption. The local heating method is unsuitable, however, for high-speed printing. Pressure roller 23 is supported elastically by a spring unit 23*a* and spring unit 23*a* applies a predetermined pressure to print paper 14 passing between pressure roller 23 and film tube 21.

Figure 5:
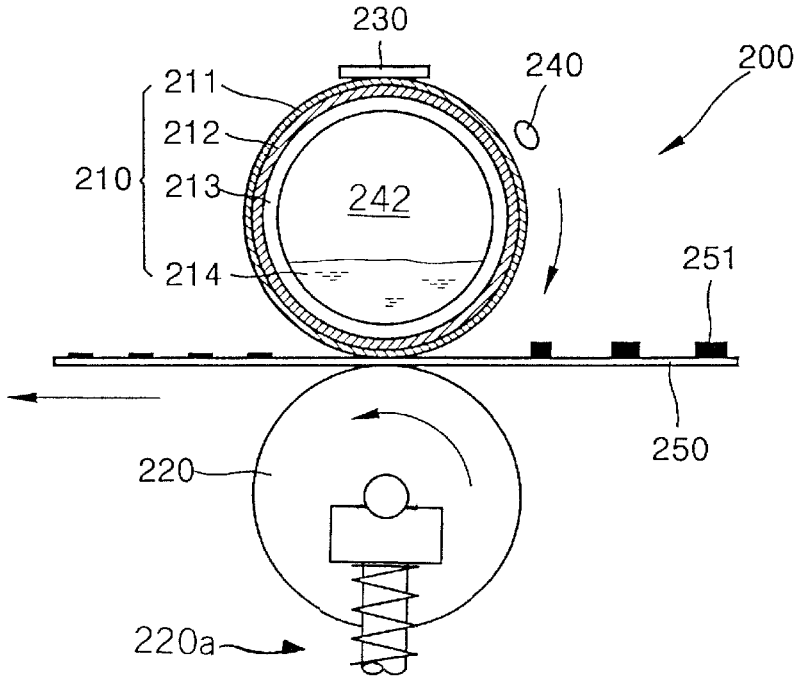
FIG. 5 is a cross-sectional view of a fixing unit of an electrophotographic image forming apparatus that incorporates a first embodiment of a fusing roller apparatus constructed according to the principles of the present invention.

A fixing unit of an electrophotographic image forming apparatus incorporating a first embodiment of a fusing roller apparatus according to the present invention is shown in FIG. 5, while FIG. 6 is a perspective view of FIG. 5 showing the structure of the fusing roller apparatus in greater detail, and FIG. 7 is a longitudinal sectional view of the fusing roller apparatus of FIGS. 5 and 6.

Referring to FIGS. 5, 6 and 6A together, the fixing unit 200 includes a fusing roller apparatus 210 which rotates in a direction in which a print paper 250 bearing a toner image 251 a is ejected, i.e., clockwise as viewed in FIG. 5, and a pressure roller 220 which rotates counterclockwise in contact with the fusing roller apparatus 210. The fusing roller apparatus 210 includes a cylindrical fusing roller 212 having a protective outer cylindrical layer 211, which is formed on the surface thereof by coating with Telfon, and a heat-generator 213 installed in the fusing roller 212. A thermistor 230 for sensing the surface temperature of the fusing roller 212 is mounted on the top of the fusing roller 212. The pressure roller 220 is supported by a spring unit 220*a* that applies a predetermined pressure to print paper 250 passing between pressure roller 230 and fusing roller apparatus 210.

Thermistor 230 is in direct physical contact with protective layer 211 and senses the temperature of the protective layer 211. The inner space formed by the interior cylindrical cavity 242 of the fusing roller 212 is evacuated to a predetermined level of vacuum. Heat-generator 213 may be a helical winding made with a spiral resistance heating coil installed along the interior cylindrical cavity 242 in direct physical contact with the inner cylindrical wall of fusing roller 212. The heat-generator 213 includes a heat-generating wire 213*a* formed of an electrically resistive material such as either iron chromium (Fe—Cr) or nickel-chromium (Ni—Cr) coil, and an electrically insulating covering layer 213*c* formed of magnesium oxide (MgO) to protect the heat-generating wire 213*a*. Insulating covering layer 213*b* of the heat-generator 213 prevents deformation or characteristic changes in heat-generating wire 213*a*, which are prone to occur over time or are caused by temperature variations in a working fluid 214 to be described later. An outer layer (sheath) 213*b* made of a relatively inert material such as stainless steel, forms a protective sheath around insulating layer 213*c*. A plurality of axially spaced-apart electrical insulators 213*d* hold wire 213*a* approximately coaxially spaced within the center of layer 213*c*, spaced-apart from sheath 213*b*.

Figure 6B:
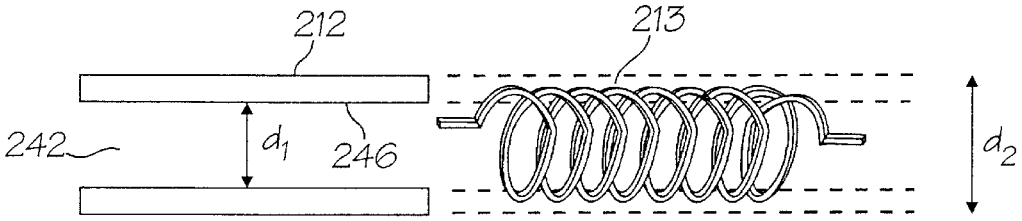
FIGS. 6B, 6C and 6D illustrate a sequence of steps in the construction of a fusing roller apparatus according to the principles of the present invention.
Figure 6C:
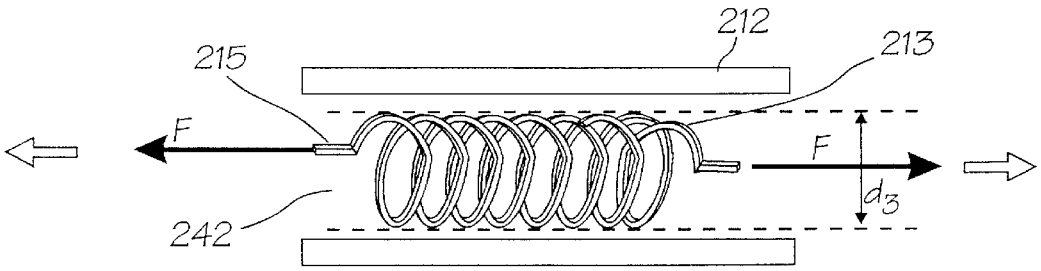
Figure 6D:
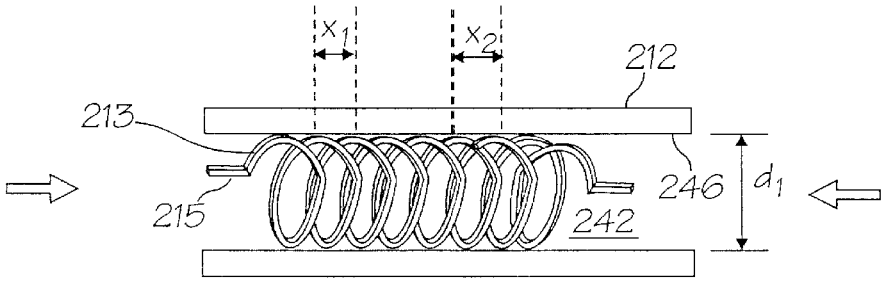

As illustrated in FIGS. 6B, 6C and 6D, the distance between diametrically opposite interior walls of the inner cylindrical surface 246 of fusing roller or heat pipe 212 is $d_1$, while the outer cylindrical surface of heat pipe 212 has a diameter of $d_2$. Heat generator or coil 213 has an outer cylindrical diameter greater than $d_1$ and slightly less than $d_2$. As shown in FIG. 6C, a force F is applied to electrodes 215 at axially opposite ends of coil 213 to reduce the diameter of coil 213 to evaluate $d_3$, that is less than $d_1$, while coil 213 is inserted into the interior cavity 242 of heat pipe 212. As shown FIG. 6D, upon removal of force F, the other surfaces of each loop of coil 213 are in direct physical and thermal contact with inner cylindrical surface 246 of heat pipe 212; in essence, the removal of force F allows coil 213 to assume an outer cylindrical diameter $d_1$, equal to the inner diameter of heat pipe 212. The pitch $x_1$, $x_2$ between neighboring loops of coil 213 are not necessary equal. What is important however, is that most, or all of the exterior surface of each loop of coil 213 lie in direct physical and thermal contact with interior cylindrical surface 246 of heat pipe 212.

The working fluid 214 is contained in the sealed inner space of fusing roller 212 in which heat-generator 213 is installed. The working fluid 214 is contained in an amount of 5–50% by volume, and preferably, 5–15% by volume based on the interior cavity 242 of the fusing roller 212. The working fluid 214 prevents local surface temperature deviations of the rotating fusing roller 212, which occur due to the presence of the heat-generator 213, based on the principles of a heat pipe, and serves as a thermal medium capable of uniformly heating the entire cylindrical volume of fusing roller 212 within a shorter period of time than is currently available with conventional apparatus. If the amount of the working fluid 214 is less than about 5% by volume based on the volume of the fusing roller 212, a dry-out phenomenon is likely to occur in which the working fluid 214 is not fully vaporized and liquified immediately after vaporization should have otherwise occurred.

Fusing roller 212 may be formed of a stainless steel (such as 304SS) or copper (Cu). If fusing roller 212 is formed of stainless steel, most of the well-known working fluids, except for water (distilled water) can be used. FC-40 (available from 3M Corporation ) is the most preferred alternative to water as working fluid 214. Meanwhile, if the fusing roller 212 is formed of copper, almost all of the well-known working fluids can be used. Water (e.g., distilled water) is the most preferred working fluid for fusing rollers 212 made of copper.

Referring now to FIG. 7, caps 218 are coupled to both of the axially opposite ends of fusing roller 212 to seal the interior cylindrical cavity 242 of fusing roller 212 and thereby form a vacuum tight sealed inner space. The axially opposite terminal ends of coil 213 form electrodes 215 that extend axially through and beyond caps 218 to operationally engage electrical contacts such as slip rings (not shown) that in turn, provide an electrical current through coil 213. A non-conductive bushing 216 and a gear-binding cap 217 may also be mounted on the exterior cylindrical surface of fusing roller 212. The electrodes 215 are electrically connected to electrically conducting end leads of heat-generator 213. Although the electrical connection that couples the structure of the heat-generator 213 and the electrodes 215 to a source of electrical power is not illustrated in great detail, this structure can be easily implemented.

During operational use, fusing roller apparatus 210 having the structure described above is rotated by a separate rotation unit. For this purpose, additional parts may be installed. For example, the gear-binding cap 217 is an additional part to be coupled to a rotating spur gear required for rotating fusing roller apparatus 210.

In a fixing unit 200 of the electrophotographic image forming apparatus constructed according to the principles of the present invention, as an electrical current flows into the heat-generator 213 through the electrodes 215, i.e., from an electrical power supply, the heat-generator 213 generates heat due to resistance heating as the electrical current flows through the helical coil of heat generator 213, and the fusing roller 212 is heated from the inside out by the resulting heat.

At the same time, working fluid 214 contained in the fusing roller 212 is vaporized by the heat. The heat generated by the heat-generator 213 is transferred to the cylindrical wall of the fusing roller 212, and at the same time the body of the fusing roller 212 is uniformly heated by the vaporized working fluid. As a result, the surface temperature of the fusing roller 212 reaches a target fusing temperature within a substantially shorter period of time. A wick 244 made of a perforated layer or screen of metal made from copper or stainless steel is formed in a cylindrical shape to serve as a capillary; wick 244 may be placed along inner cylindrical surface 246, between neighboring windings of coil 213. Suitable materials for the fusing roller 212 are listed in Table 2. FC-40 or water (distilled water), previously described, or the materials listed in Table 3 may be used as working fluid 214. When water (distilled water) is selected as working fluid 214, the fusing roller apparatus 210 can be implemented at low cost without environmental concern. Once the temperature of the fusing roller 212 reaches a target fusing temperature at which the toner image is fused, the toner image is transferred (i.e., permanently bonded) to the print paper. As the print paper to which the toner image has been transferred absorbs the heat from the fusing roller 212, the vaporized working fluid changes back into its liquid phase inside cavity 242 of fusing roller 212. The liquefied working fluid may be subsequently heated again by heat-generator 213 to vaporize, so that the temperature of the fusing roller 212 can be maintained at a predetermined temperature.

If the fusing temperature of toner is in the range of 160–180° C., a fusing roller apparatus constructed according to the present invention can reach the target temperature within approximately ten seconds. Then, the surface temperature of the fusing roller 212 is maintained by intermitted application of an electrical current to coil 213, within a predetermined range of temperature by the thermistor 230 in response to the surface temperature of the fusing roller 212 sensed by thermistor 230. If the thermistor 230 and a controller fail to properly control the surface temperature so that the surface temperature of fusing roller 212 suddenly rises, a thermostat 240 located in close operational proximity to the cylindrical surface of fusing roller 212 senses the surface temperature of the fusing roller 212 and cuts off the supply of electrical current to coil 213 to prevent overheating. The power supply operation may be varied depending on the target temperature. It will be appreciated that the power supply operation can be controlled by such control techniques as periodic power on/off control or a duty cycle ratio.

A fusing roller apparatus having the configuration may be manufactured by the steps of:

(a) preparing a metal pipe as a material for the fusing roller;

(b) cleaning the exposed surfaces of the metal pipe by washing the metallic pipe with distilled water or volatile liquid;

(c) cleaning the exposed surfaces of a spiral resistance heating coil by washing the spiral resistance heating coil with distilled water or volatile liquid;

(d) inserting the spiral resistance heating coil wound as a helical coil with an outer diameter that is equal to or slightly larger than the inner diameter of the metallic pipe, into the annular inner cylindrical volume of the metallic pipe;

(d') optionally, inserting a wick between neighboring turns of the heating coil;

(e) sealing opposite base ends of the metallic pipe with end caps such that a working fluid inlet remains, while both end leads of the resistance heating coil extend through the metallic pipe as electrical leads;

(f) purging extraneous gases from the inner volume by evacuating, heating, and cooling the metallic pipe to exhaust gases from the inner volume of the pipe to create a vacuum within the inner volume;

(g) injecting 5–50% by volume, a working fluid (such as either FC-40 or distilled water) through a working fluid inlet;

(h) sealing the working fluid inlet of the metallic pipe;

(i) spray-coating the surface of the metallic pipe with Teflon, and drying and polishing the metallic pipe;

(j) inserting a non-conductive bushing as a bearing into one end of the metallic pipe; and (k) mounting a gear-mounting cap made of metal, heat-resistant plastic, or epoxy at the one end of the fusing roller formed by the metallic pipe.

During the manufacture of the fusing roller apparatus, when weld-capping the metallic pipe with end caps 218 at axially opposite base ends after the insertion of the spiral resistance heating coil (and insertion of a wick, if a wick is to be used), argon gas is injected into interior cavity 242 of the metallic pipe via the working fluid inlet for the purpose of preventing oxidation of the heat pipe 212. Before injecting the working fluid 214 into the metallic pipe 212, extraneous gases are purged from the interior cavity 242 and the interior cavity is evacuated and is repeatedly heated and cooled under a vacuum so as to exhaust all gases out of the interior cavity of the heat pipe 212, thereby removing substantially all foreign substances adhering to the inner wall of the metallic pipe. For example, in one process for purging interior cavity 242, the metallic pipe must be heated to a temperature of 250° C. with an internal pressure of forty (40) atmospheres. At room temperature, interior cavity 242 should have a perfect pressure; that is, there should be no molecules within cavity 242.

Figure 8A:
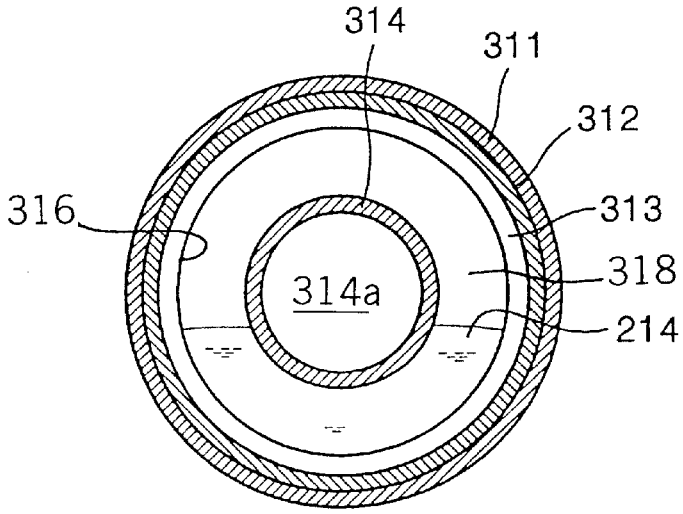
FIG. 8A is a cross-sectional view of a second embodiment of the fusing roller apparatus constructed according to the principles of the present invention.
Figure 8B:
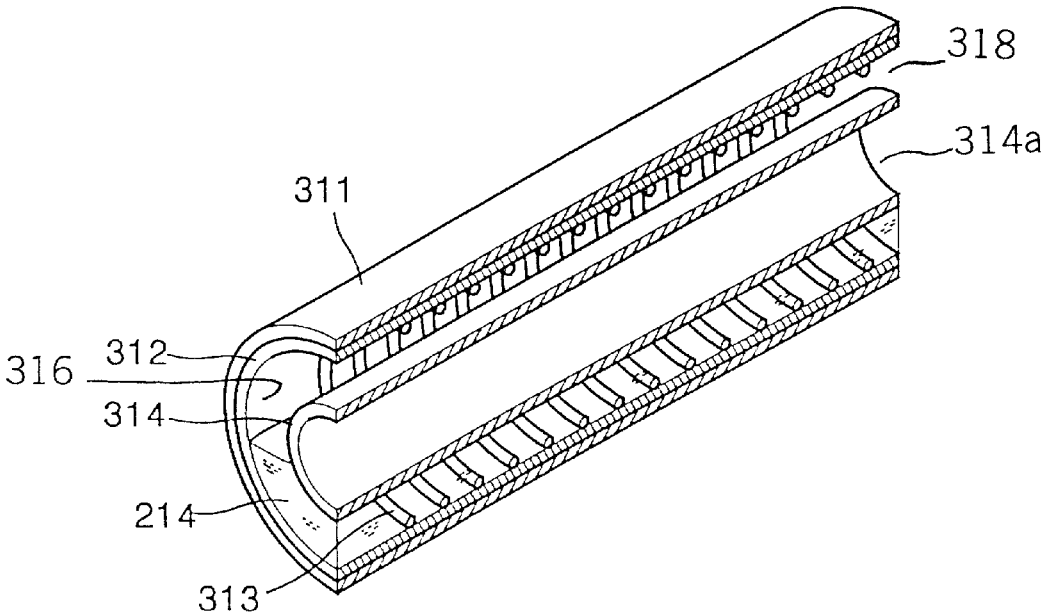
FIG. 8B is a partial longitudinal sectional view of the fusing roller apparatus illustrated by FIG. 8A.

FIG. 8A is a cross-sectional view of a second embodiment of the fusing roller apparatus constructed according to the principles of the present invention, and FIG. 8B is a partial longitudinal sectional view of the fusing roller apparatus of FIG. 8A. Referring to FIGS. 8A and 8B, an outer tube 312 in formed with an outer surface that is coated with a protective layer 311 of a material such as Teflon is formed. An inner tube 314 having an exterior diameter that is smaller than the inner diameter of outer tube 312 is coaxially located in the middle of the outer tube 312. An annular space 318 that accommodates a working fluid 214 and a heat-generator 313 are provided between the outer tube 312 and the inner tube 314. The heat-generator 313 is formed along the inner cylindrical surface 316 of the outer tube 312. A lower portion of the annular space is filled with the working fluid 214. The inner cylindrical volume 314*a* of inner tube 314 may be either solid, hollow or an evacuated cylindrical cavity.

Figure 9A:
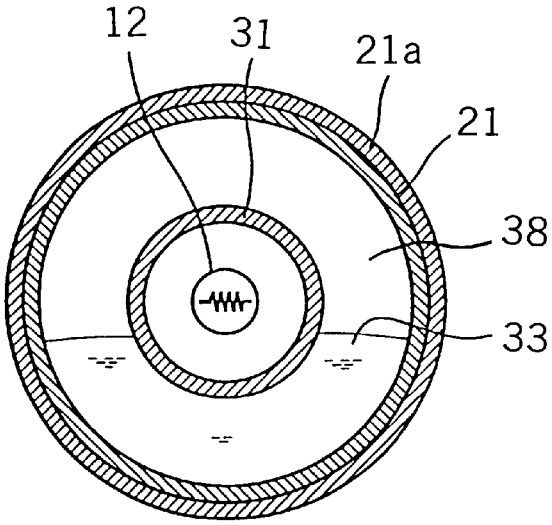
FIG. 9A (PRIOR ART)
FIG. 9A is a cross-sectional view of a conventional design for a fusing roller apparatus.
Figure 9B:
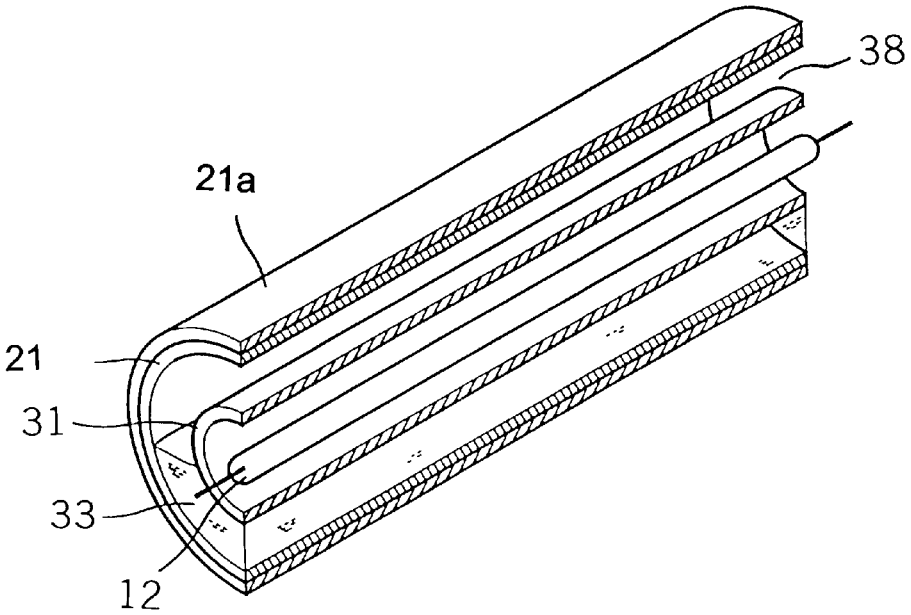
FIG. 9B (PRIOR ART)
FIG. 9B is a partial longitudinal sectional view of the fusing roller apparatus illustrated by FIG. 9A.

FIG. 9A is a cross-sectional view of a different design of a conventional fusing roller apparatus, and FIG. 9B is a partialiy cut-away longitudinal sectional view of the fusing roller apparatus of FIG. 9A. This construction of a fusing roller apparatus differs from other designs of fusing roller apparatus in the location of the heat-generator 313. Referring again to FIGS. 9A and 9B, an outer tube 21 is formed with an outer surface coated with a protective layer 21*a*. An inner tube 31 having an exterior diameter that is smaller than the interior diameter of outer tube 21 is coaxially located in the middle of the hollow cylindrical cavity outer tube 21. A hollow annular space 38 for a working fluid 33 is provided between the interior cylindrical surface of outer tube 21 and the exterior cylindrical surface of inner tube 31. A heat-generator 12 for heating the inner surface of the inner tube 31 by radiation is provided in the middle of the inner tube 31. The heat-generator 12 is a radiant heat generating device such as a halogen lamp. The inner tube 31 is heated by radiant heat from the heat-generator 12 so that the working fluid 33 in contact with the outer cylindrical surface of the inner tube 31 is evaporated and vaporizes, that is, changes from a liquid phase to a gaseous phase.

Figure 10A:
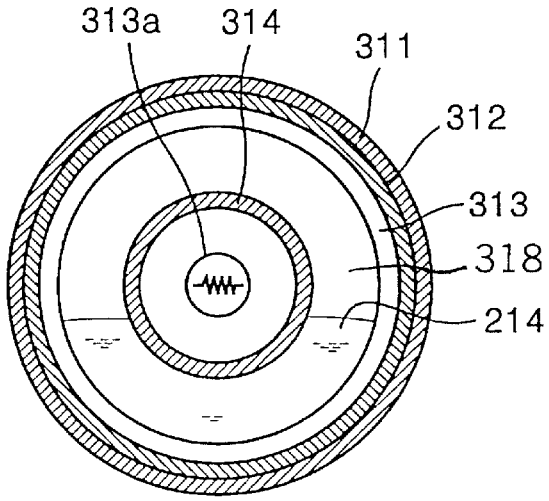
FIG. 10A is a cross-sectional view of a fourth embodiment of the fusing roller apparatus constructed according to the principles of the present invention.
Figure 10B:
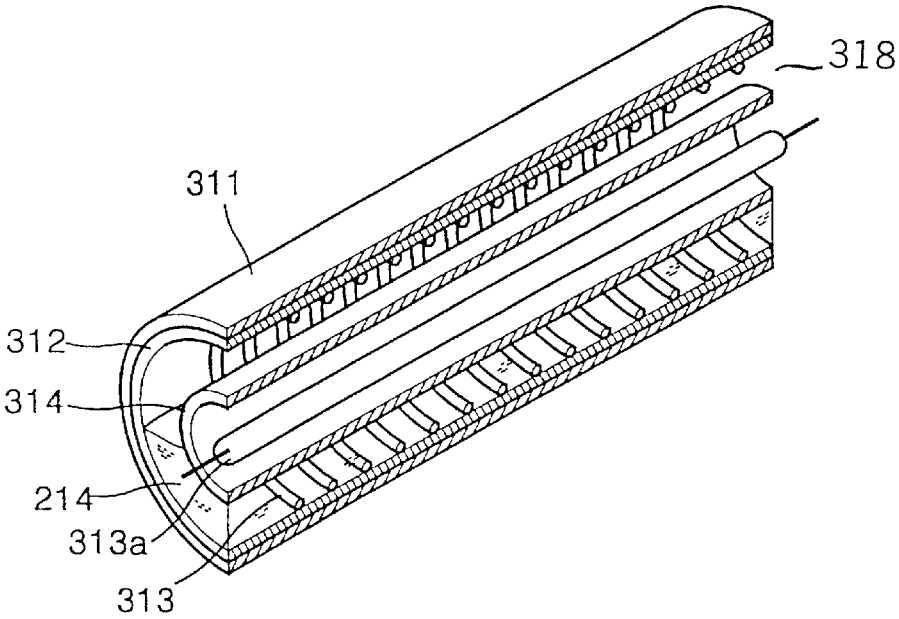
FIG. 10B is a partial longitudinal sectional view of the fusing roller apparatus illustrated by FIG. 10A.
Figure 10C:
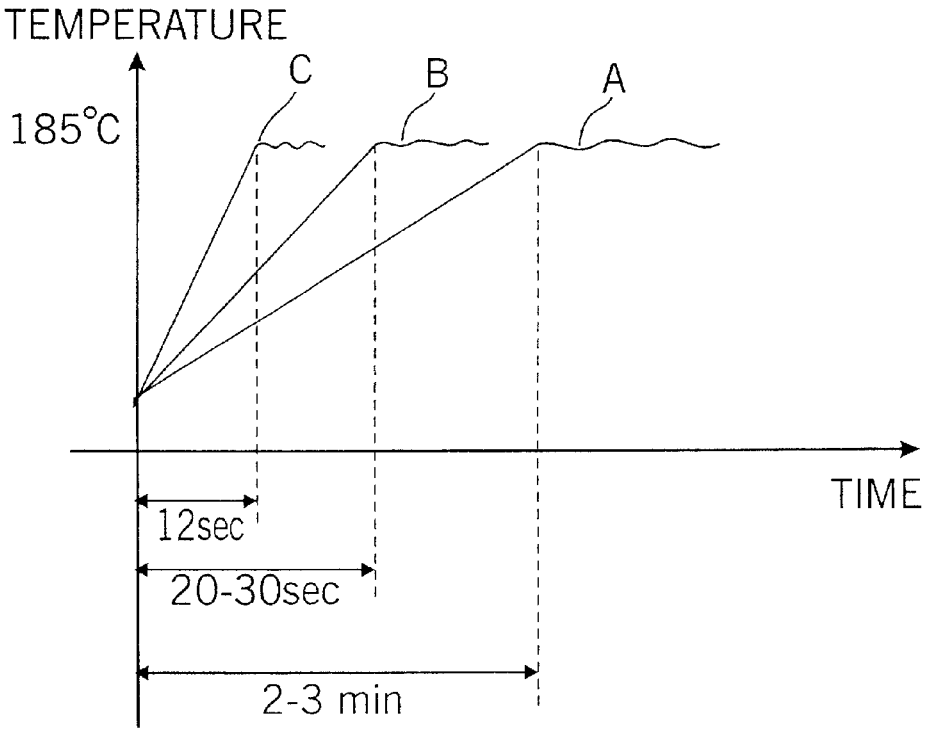
FIG. 10C is a two coordinate graph illustrating comparisons between two conventional designs and an embodiment of the present invention.

FIG. 10A is a cross-sectional view of a third embodiment of a fusing roller apparatus constructed according to the principles of the present invention, and FIG. 10B is a partial longitudinal sectional view of the fusing roller apparatus of FIG. 10A. This third embodiment of the fusing roller apparatus is a modified version of the second embodiment of the present invention. Referring to FIGS. 10A and 10B, an outer tube 312 is formed with an outer surface that is coated with a protective layer 311 of a material such as Teflon. An inner tube 314 having exterior diameter that is smaller than the interior diameter of outer tube 312 is coaxially located in the hollow middle of the outer tube 312. An annular space 318 contains a working fluid 214, and a first heat-generator 313 is provided between the outer tube 312 and the inner tube 314. A second heat-generator 313*a* serving to heat the inner wall of the inner tube 314 by radiant heating, is coaxially located in the hollow middle of the inner tube 314. The second heat-generator 313*a* is a radiant heat generating device such as a halogen lamp. Inner tube 314 is heated by radiant heat from second heat-generator 313*a* so that the working fluid 214 in contact with the outer surface of the inner tube 314 vaporizes and assumes its vapor phase. The first heat-generator 313 is formed along the inner cylindrical surface of outer tube 312 and directly heats the inner cylindrical surface of the outer tube 312 and also directly heats the working fluid 214 and causes working fluid 214 to evaporate once the fusing roller apparatus is removed from its stand-by status. The working fluid 214 in the hollow annular space 318 between outer tube 312 and inner tube 314 is simultaneously heated by both the first and second heat-generators 313 and 313*a* to vaporization. Turning now to FIG. 10C, the structure of the fusing roller apparatus according to this third embodiment of the present invention can be efficiently heated within a substantially shorter period of time compared with the other embodiments described previously.

FIG. 10C illustrates relative performance between two conventional designs and an embodiment of a fusing roller assembly constructed according to the principles of the present invention, by comparing the time required for these rollers to reach an operational temperature. Curve A illustrates a fusing roller constructed with a halogen heat lamp such as illustrated by FIG. 2. This design requires a period of between two and three minutes for the exterior surface of the fusing roller to reach an operational temperature of 185° C. Curve B represents the performance of an indirectly heated design such that illustrated by FIGS. 9A, 9B; this design requires a period of between twenty and thirty seconds for the exterior surface of the fusing roller to reach 185° C. Curve C illustrates one embodiment constructed as illustrated in FIGS. 10A, 10B; this embodiment requires a period of approximately twelve seconds to reach an operational temperature of 185° C. Additionally, unlike the halogen heat lamp assembly represented by Curve A and indirectly heated assembly represented by Curve B, the temperature differential over the axial length of the exterior circumferential surface of the fusing roller in embodiments constructed according to the principles of the present invention, is less than two degrees Celsius, and in many cases, is less than one degree Celsius over the axial length. In contradistinction, halogen heat lamp and indirectly heated designs vary in temperature difference over the axial length by more than two degree Celsius with the terminal ends often being more than two degrees Celsius colder than the central portion of the fusing roller.

Figure 11A:
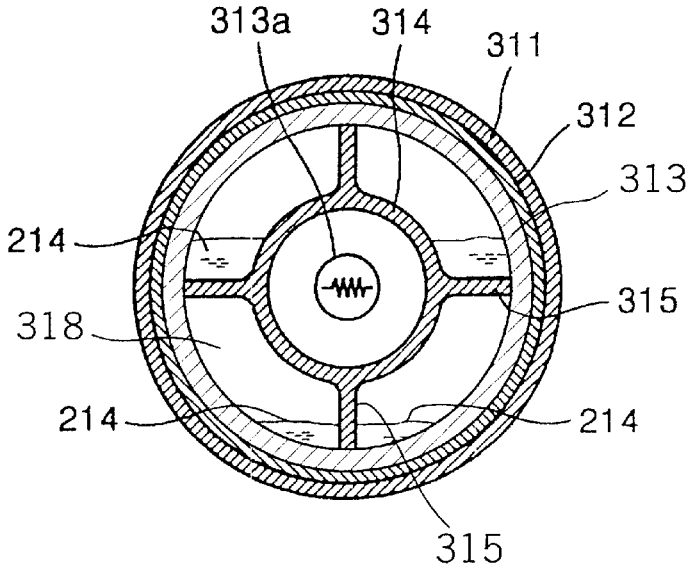
FIG. 11A is a cross-sectional view of a fifth embodiment of the fusing roller apparatus constructed according to the principles of the present invention.
Figure 11B:
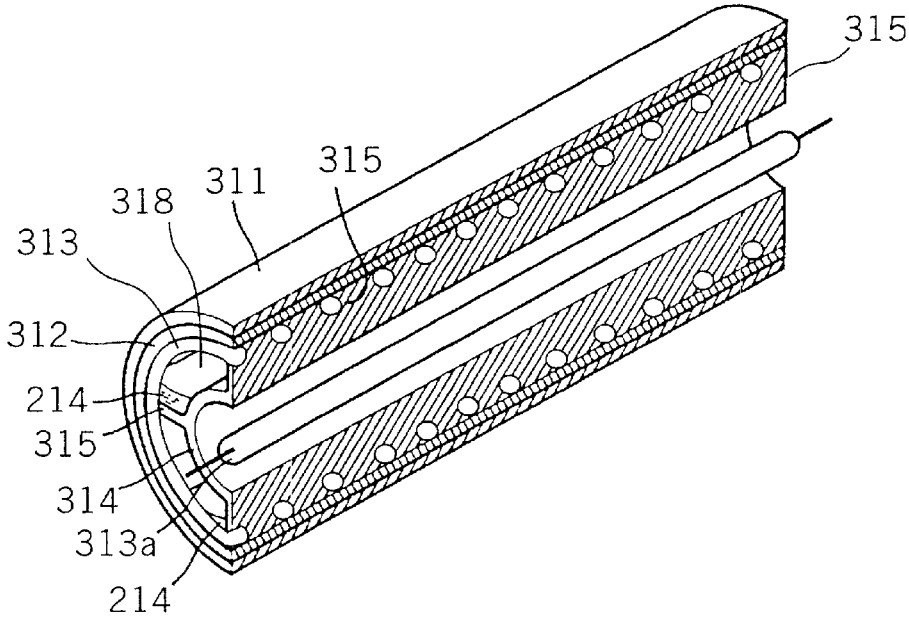
FIG. 11B is a partial longitudinal sectional view of the fusing roller apparatus illustrated by FIG. 11A.

FIG. 11A is a cross-sectional view of a fourth embodiment of the fusing roller apparatus constructed according to the principles of the present invention, and FIG. 11B is a partial longitudinal sectional view of the fusing roller assembly of FIG. 11A. A hollow annular space 318 of the fourth embodiment of the fusing roller apparatus is divided by a plurality of arcuately spaced apart radial webs (partitions) 315 that extend radially between the outer cylindrical surface of inner tube 314, and across annular space 318 to the inner cylindrical surface of outer tube 312. The annular space 318 of the fusing roller apparatus is thus divided into a plurality of discrete sections that may, or may not be connected to allow passage of gaseous phase of the working fluid 214 between sections, depending on the design of the embodiment. The exterior circumferential surface of outer tube 312 has an outer surface coated with a protective layer 311. Inner tube 314 has an exterior diameter that is substantially smaller than the interior diameter of outer tube 312 and is located coaxially in the middle of the outer tube 312, so that the hollow annular space 318 that holds working fluid 214 is provided between the outer tube 312 and the inner tube 314. The annular space 318 is divided into unit spaces by a plurality of partitions 315 that are coaxially mounted within the hollow central bore of outer tube 312 with a plurality of radial webs 315 forming sector partitions of annular space 318 radially arranged at a predetermined angle. Working fluid 214 is contained in each of the unit spaces. A heat-generator 313*a* for heating the inner surface of the inner tube 314 by radiation is coaxially mounted inside the middle of the inner tube 314. Heat-generator 313*a* is a radiant heat generating device such as a halogen lamp. A second heat-generator 313 is a resistive heat generator and is pressed against an inner surface of outer tube 312. The inner tube 314 is heated by radiant heat from the heat-generator 313*a* so that the working fluid 214 in contact with the outer surface of the inner tube 314 is evaporated. The working fluid 214 transfers heat to the outer tube 312 through evaporation and condensation cycles in each of the unit spaces. The partitions 315 may be formed as separate parts or as a combined form with the outer surface of the inner tube 214. The working fluid 214 is distributed in each of the unit spaces, so that the working fluid 214, which is in contact with the inner surface of the outer tube 312, rapidly evaporates and condenses in each of the unit spaces.

Figure 12:
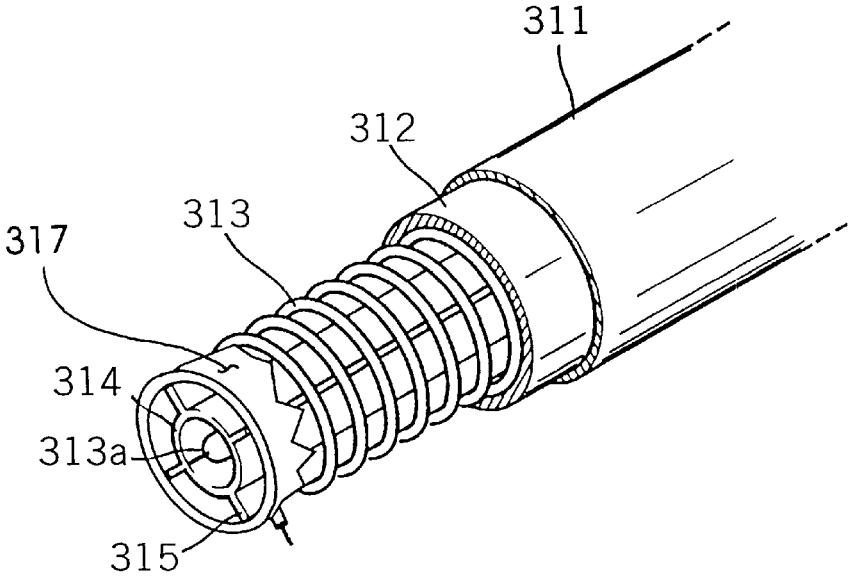
FIG. 12 is a partial perspective view of a sixth embodiment of the fusing roller apparatus according to the principles of the present invention.

FIG. 12 is a partial perspective view of a fifth embodiment of a fusing roller apparatus constructed according to the principles of the present invention. Outer tube 312 has an outer cylindrical surface that is coated with a protective layer 311 of a material such as Teflon. Inner tube 314 has a smaller outer diameter than the inner diameter of outer tube 312 and is coaxially located in the middle of the outer tube 312, so that annular space 318 for a working fluid 214 is provided between the outer tube 312 and the inner tube 314. The annular space is divided into unit spaces by a plurality of radial webs 315 radially arranged at a predetermined angle, and the working fluid 214 is contained in each of the unit spaces. A cylindrical sheath 317 made of a thermally conducting material such as stainless steel, encircles the radial outer ends of radial webs 315, and separates a first-heat generator 313 from working fluid 214 within the unit spaces. Sheath 317 and the partitions 315 around the inner tube 314 are surrounded by a first heat-generator 313 formed as a spiral resistance heater. A second heat-generator 313*a* for heating the inner surface of the inner tube 314 by radiation is provided in the middle of the inner tube 314. The second heat-generator 313*a* is a radiant heat generating device such as a halogen lamp. The inner tube 314 is heated by radiant heat from the second heat-generator 313*a* so that the working fluid 214 in contact with the outer surface of the inner tube 314 is evaporated after the fusing roller apparatus is removed from its stand-by state in preparation for printing images on a printable medium. First heat-generator 313 is also in contact with the inner surface of the outer tube 312; the outer tube 312 as well as the working fluid 214 are heated by the first heat-generator 313. The working fluid 214 transfers heat to the outer tube 312 through evaporation and condensation cycles in each of the unit spaces. The partitions 315 may be formed as separate parts or as a combined form together with the inner surface of sheath 317. Although annular space 318 between the outer tube 312 and the inner tube 314 is divided by the partitions 315, working fluid 214 can in particular embodiments flow through an orifice or a gap between the partitions 315 and the outer tube 312. In other implementations of this embodiment, sheath 317 confines the working fluid to different unit spaces and prevents flow between unit spaces.

Figure 13:
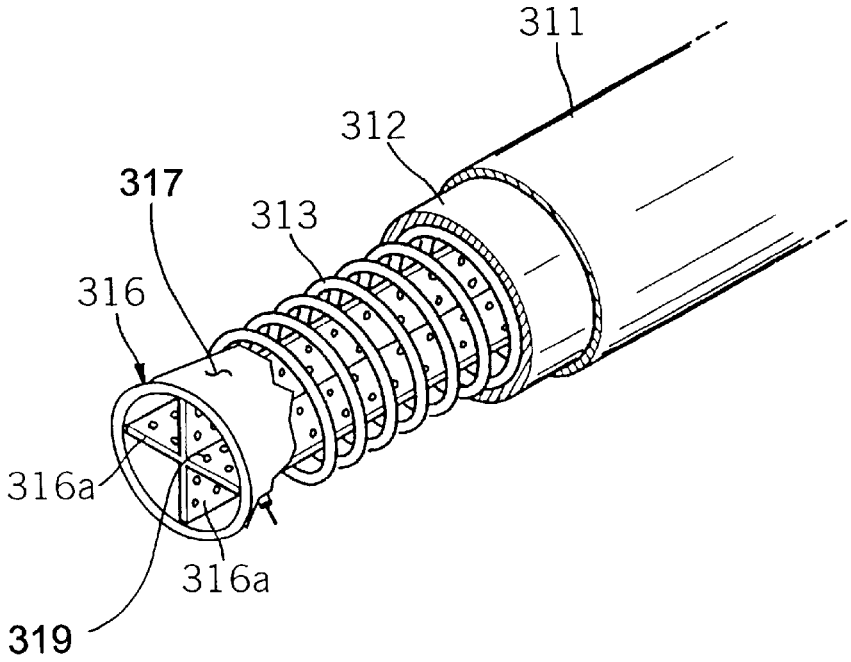
FIG. 13 is a partial perspective view of a seventh embodiment of the fusing roller apparatus constructed according to the principles of the present invention.

FIG. 13 is a partial perspective view of a sixth embodiment of the fusing roller apparatus constructed according to the principles of the present invention, to which the first embodiment of the fusing roller apparatus described previously is applied. The fusing roller apparatus of FIG. 13 includes a cylindrical fusing roller 312 whose outer surface is coated with a protective layer 311 of Teflon; a heat-generator 313 is located in annular space 318 of the fusing roller 312; and a partition 316 having a plurality of dividing webs 316*a* radially arranged to divide the annular space into sub spaces forms an outer cylindrical sheath. Partition 316 has a maximum outer diameter that is smaller than the inner diameter of the fusing roller 312 and is surrounded by the helically wound heat-generator 313. Unlike the fifth embodiment of FIG. 12, the sixth embodiment of FIG. 13 does not have heat generator 313*a* disposed along the axis of rotation of the fusing roller. Also, unlike FIG. 12, the fusing roller of FIG. 13 has a plurality of openings 319 disposed on the plurality of dividing webs 316*a* of partition 316 to allow the working fluid 214 to flow through these openings 319.

Although the sixth embodiment illustrated in FIG. 13 of the fusing roller apparatus has annular space 318 divided into a plurality of unit spaces by the dividing webs 316*a* of partition 316, the working fluid 214 can flow through openings 319 between the dividing webs 316*a* in FIG. 13.

In the embodiments described above, an electrode through which power is supplied to the heat-generators or a structure for rotating and supporting the heat-generators is not illustrated, because such structures may be easily implemented by those skilled in the art.

Figure 14:
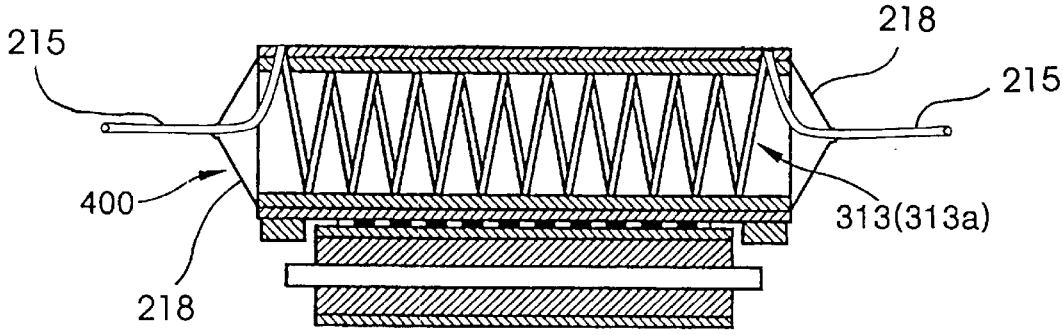
FIG. 14 is a longitudinal sectional view of the fixing unit of an electrophotographic image forming apparatus incorporating a fusing roller apparatus constructed according to the present invention.

FIG. 14 is a schematic view of the structure of a fixing unit of an electrophotographic image forming apparatus, to which a fusing roller apparatus constructed according to the principles of the present invention is applied. Axially opposite ends of a heat-generator (or coil) extend through end caps 218 to form electrodes 215; electrodes 215 are coupled to both end portions of the fusing roller apparatus 400 to provide electrical current through heat-generator 313 (and, if present, secondary heat generator 313*a*). Electrodes 215 are electrically connected to the heat-generator 313 and may slidably contact brushes (not shown) formed of a conductive material such as carbon, for example, that are in turn connected across a source of electrical power. The brushes may be elastically supported by springs, so that the brushes are pushed against electrodes 215. A thermostat that operates in dependence upon the temperature of the fusing roller apparatus 400, is connected between the brushes and a power supply unit by an electric signal line.

As current is supplied to the heat-generator (or coil) 313 (and, if present, secondary heat generator 313*a*) by the power supply, resistance heat is generated by the internal resistance of coil 313 to heat the body of the fusing roller. At the same time, the working fluid contained in the fusing roller is heated until the working fluid evaporates. The inner surface of the fusing roller is heated by the heat from the heat-generator and by vaporized (i.e. the gaseous phase) working fluid, so that the body of the fusing roller can be uniformly and quickly heated to a target fusing temperature (e.g., 185° C.). The surface temperature of the cylindrical exterior surface of the fusing roller body is detected by a separate thermistor and the amount of current supplied to the heat-generator is adjusted in dependence upon the detected temperature.

For easy understanding of the fusing roller apparatus operating in accordance with the present invention, the heat pipe associated with the present invention will be described. The term heat pipe refers to a heat transfer device that transfers heat from a high-heat density state to a low-heat density state using the latent heat required for the phase change of the working fluid from its liquid phase to its gaseous phase. Since the heat pipe utilizes the phase changing property of the working fluid, its coefficient of thermal conductivity is higher than any known metal. The coefficient of thermal conductivity of a heat pipe operating at room temperature is a few hundreds times greater than either silver or copper having a coefficient of thermal conductivity, k, of 400 W/mk.

Figure 15:
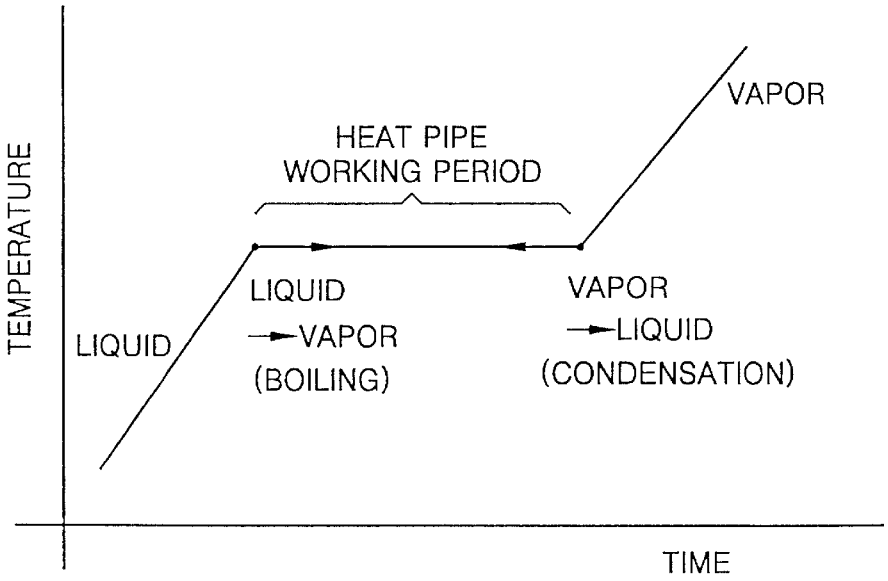
FIG. 15 is a graph illustrating the phase change of a working fluid illustrated as a function of temperature rise and the heat pipe working period of the heat pipe.

FIG. 15 is a graph illustrating the phase change of a working fluid as a function of temperature rise and the heat pipe working period. Table 1 shows the effective thermal conductivity of the heat pipe and other heat transfer materials.

TABLE 1

| Material | Effective Thermal Conductivity (W/mK) |
|---|---|
| Heat pipe | 50,000–200,000 |
| Aluminum | 180 |
| Copper | 400 |
| Diamond | 2,000 |

4.18 J of energy are required to raise the temperature of 1 kg of water from 25° C. to 26° C. When the phase of the water changes from liquid to vapor without a temperature change, 2,442 kJ of energy is required. The heat pipe transfers about 584 times greater latent heat through the liquid-vapor phase change. For a heat pipe working at room temperature, the coefficient of thermal conductivity is a few hundreds times greater than either silver or copper that are known is as excellent thermal conductors. The thermal conductivity of a heat pipe using a liquid metal as a working fluid working at high temperature amounts to $10^8$ W/mK.

Figure 16:
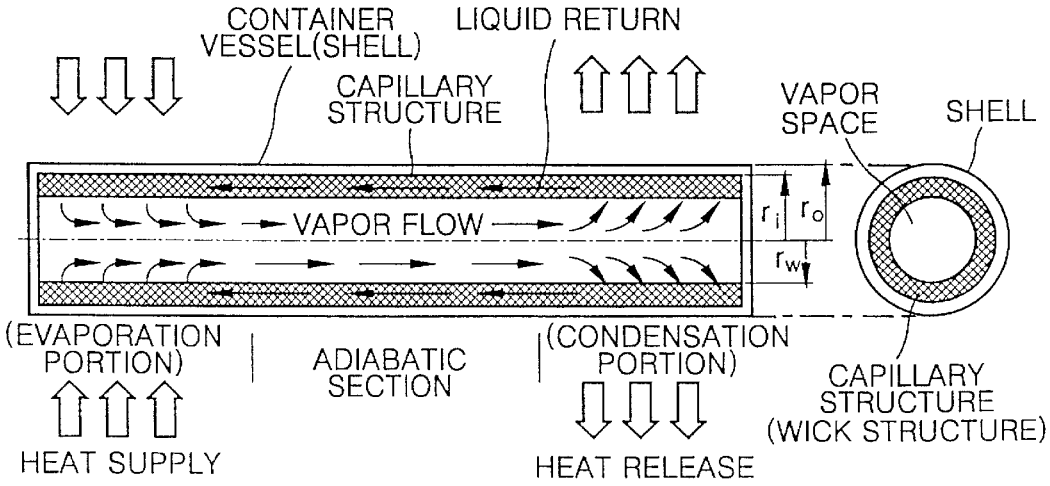
FIG. 16 shows the internal structure of the heat pipe and the heat transfer marked to indicate the liquid-vapor phase change.

FIG. 16 shows the internal structure of a heat pipe incorporating a wick to provide a capillary structure within the interior of the heat pipe, and its heat transfer process according to the liquid-to-vapor and the vapor-to-liquid phase changes. The resistance heating coil (not separately shown in FIG. 16) and the wick are arranged in a cylindrical shape and mounted directly against the interior circumferential surface of the heat tube. Table 2 shows the recommended and NOT-recommended heat pipe materials for a variety of working fluids.

TABLE 2

| Working fluid | Recommended | NOT recommended |
|---|---|---|
| Ammonia | Aluminum, Carbon steel, Stainless steel, Nickel | Copper |
| Acetone | Aluminum, Copper, Stainless steel, Silica | — |
| Methanol | Copper, Stainless steel, Nickel, Silica | Aluminum |
| Water | Copper, 347 Stainless steel | Aluminum, Stainless steel, Nickel, Carbon steel, Inconel, Silica |
| Thermex | Copper, Silica, Stainless steel | — |

Table 3 shows a variety of suitable working fluids for different working temperature ranges.

TABLE 3

| Extreme low temperature (−273~−120° C.) | Low temperature (−120~−470° C.) | High temperature (−450~−2700° C.) |
|---|---|---|
| Helium<br>Argon<br>Nitrogen | Water<br>Ethanol<br>Methanol, Acetone, Ammonia, Freon | Cesium<br>Sodium<br>Lithium |

We have found that there are several considerations in selecting a working fluid: 1) compatibility with the material of the heat pipe used; 2) a working fluid that is appropriate working temperature within the heat pipe; and 3) thermal conductivity of the working fluid.

When a heat pipe type fusing roller is formed of stainless steel (SUS) or copper (Cu), suitable working fluids are limited in terms of the compatibility with the material of heat pipe and the working temperature. FC-40 has a one atmosphere or less saturation pressure at a working temperature of 165° C. and is considered to be a relatively suitable material.

FC-40 is known to be non-toxic, non-flammable and compatible with most metals. FC-40 also has a zero-ozone depletion potential. According to the thermodynamics of FC-40 as a working fluid, the relation between the saturation temperature and pressure is expressed by formula (1):

$$\log_{10} P\ (\text{torr}) = A - \frac{B}{(T + 273)} \tag{1}$$

where A=8.2594, and B=2310, and temperature T is measured in degrees Celsius.

Figure 17:
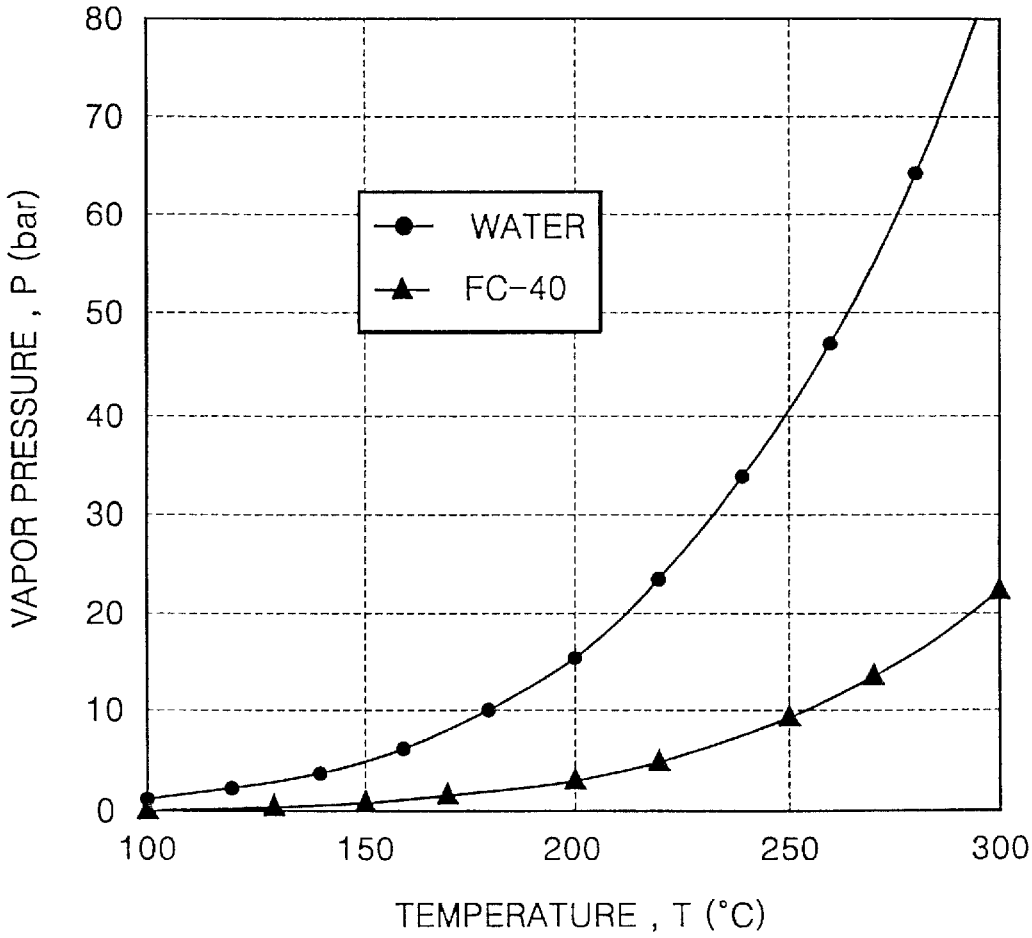
FIG. 17 is a graph showing the saturation pressure variations as a function of the saturation temperatures for FC-40 and distilled water used separately as a working fluid.

FIG. 17 is a graph showing the saturation pressure variations with respect to saturation temperature for FC-40 and water as a working fluid. Table 4 shows the saturation pressures of FC-40 at particular saturation temperatures taken from FIG. 15.

TABLE 4

| Saturation Temperature (° C.) | Saturation Pressure (bar) |
|---|---|
| 100 | 0.15 |
| 150 | 0.84 |
| 200 | 3.2 |

TABLE 4-continued

| Saturation Temperature (° C.) | Saturation Pressure (bar) |
|---|---|
| 250 | 9.3 |
| 300 | 22.54 |
| 350 | 47.5 |
| 400 | 89.5 |
| 450 | 154.6 |

In terms of safe operation of the heat pipe, suitable materials for the heat pipe and the thickness of its end cap are determined according to the the American Society of Mechanical Engineers (i.e., ASME) code which is a safety measuring standard for pressure containers. For example, if the thickness of a cylindrical heat pipe is within 10% of its diameter, maximum stresses applied to the wall ($\sigma_{max(1)}$) and semispherical end cap ($\sigma_{max(2)}$) of the heat pipe are expressed as:

$$\sigma_{\max(1)} = \frac{\Delta P d_0}{2t_1} \tag{2}$$

$$\sigma_{\max(2)} = \frac{\Delta P d_0}{2t_2}$$

where ΔP is difference in pressure between inside and outside the heat pipe, $d_0$ is the outer diameter of the heat pipe, $t_1$ is the thickness of the heat pipe, and $t_2$ is the thickness of the end cap.

According to the ASME code, the maximum allowable stress at an arbitrary temperature is equal to 0.25 times the maximum ultimate tensile strength at that temperature. If the vapor pressure of a working fluid is equal to the saturation vapor pressure of the working fluid, the difference in pressure (ΔP) is equal to the difference between the vapor pressure and atmospheric pressure.

Figure 18:
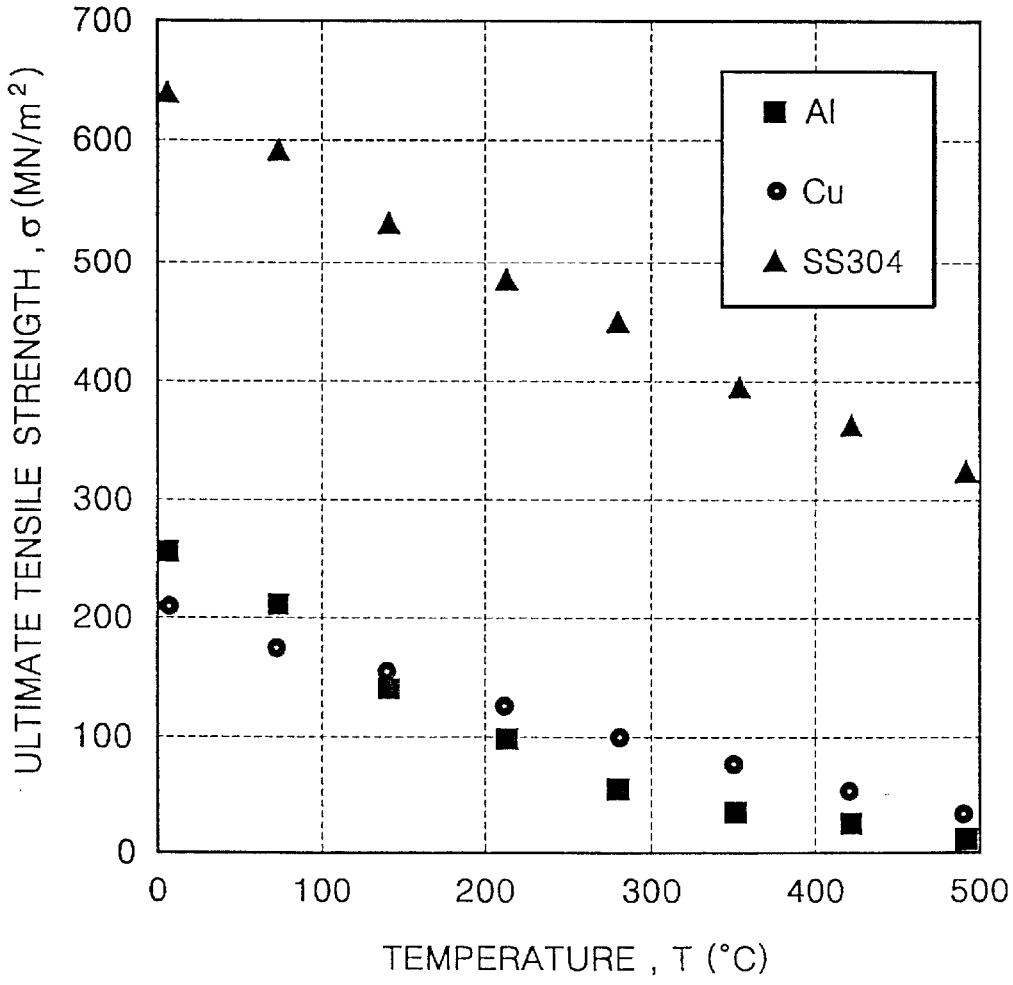
FIG. 18 is a graph of the ultimate tensile strength variations as a function of the temperature variations for the heat pipe materials of aluminum, copper and 304 stainless steel.
Figure 19A:
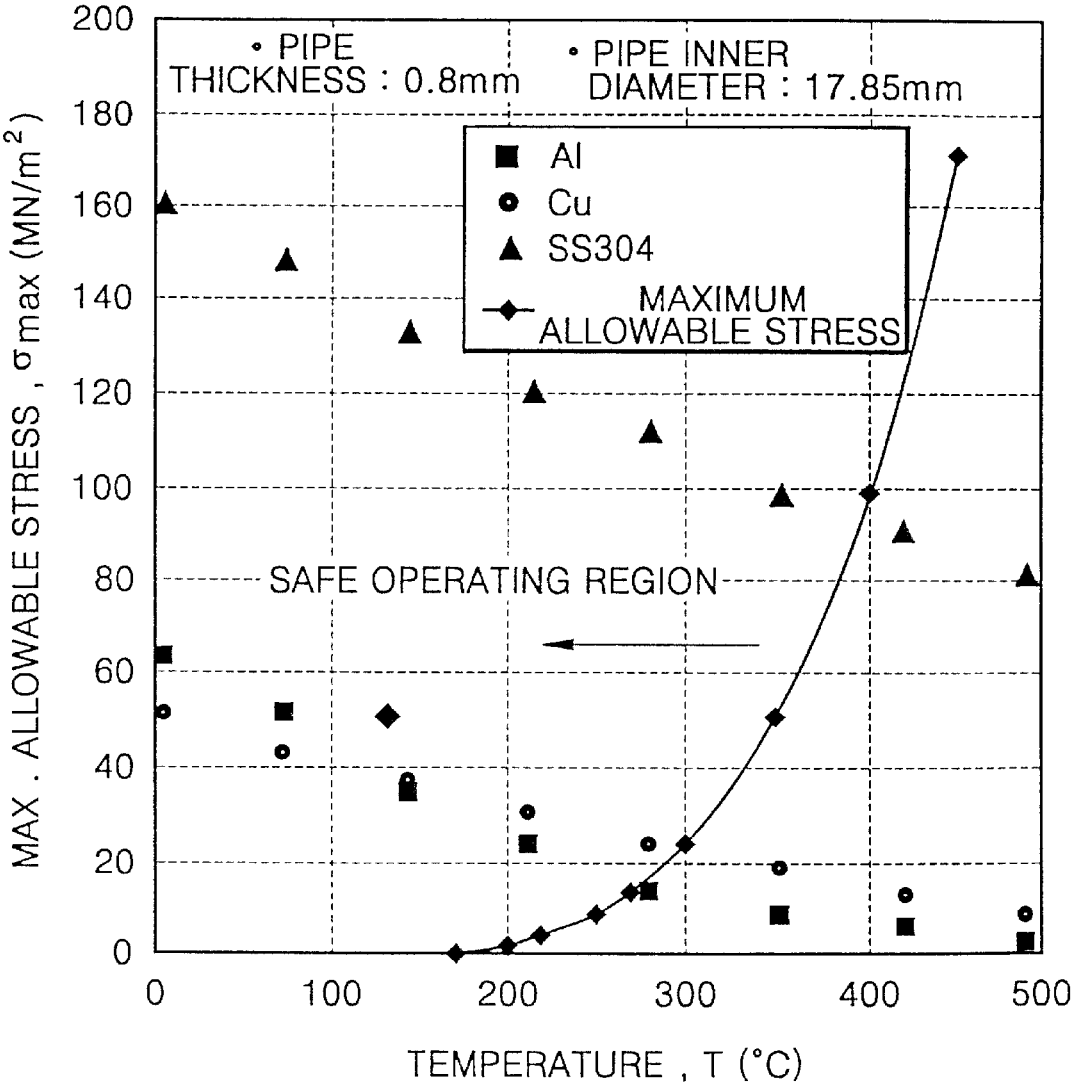
FIGS. 19A and 19B are graphs illustrating the maximum allowable stress and the maximum stress variations upon the heat pipe wall with respect to temperature variations when FC-40 and distilled water are respectively used as a working fluid.
Figure 19B:
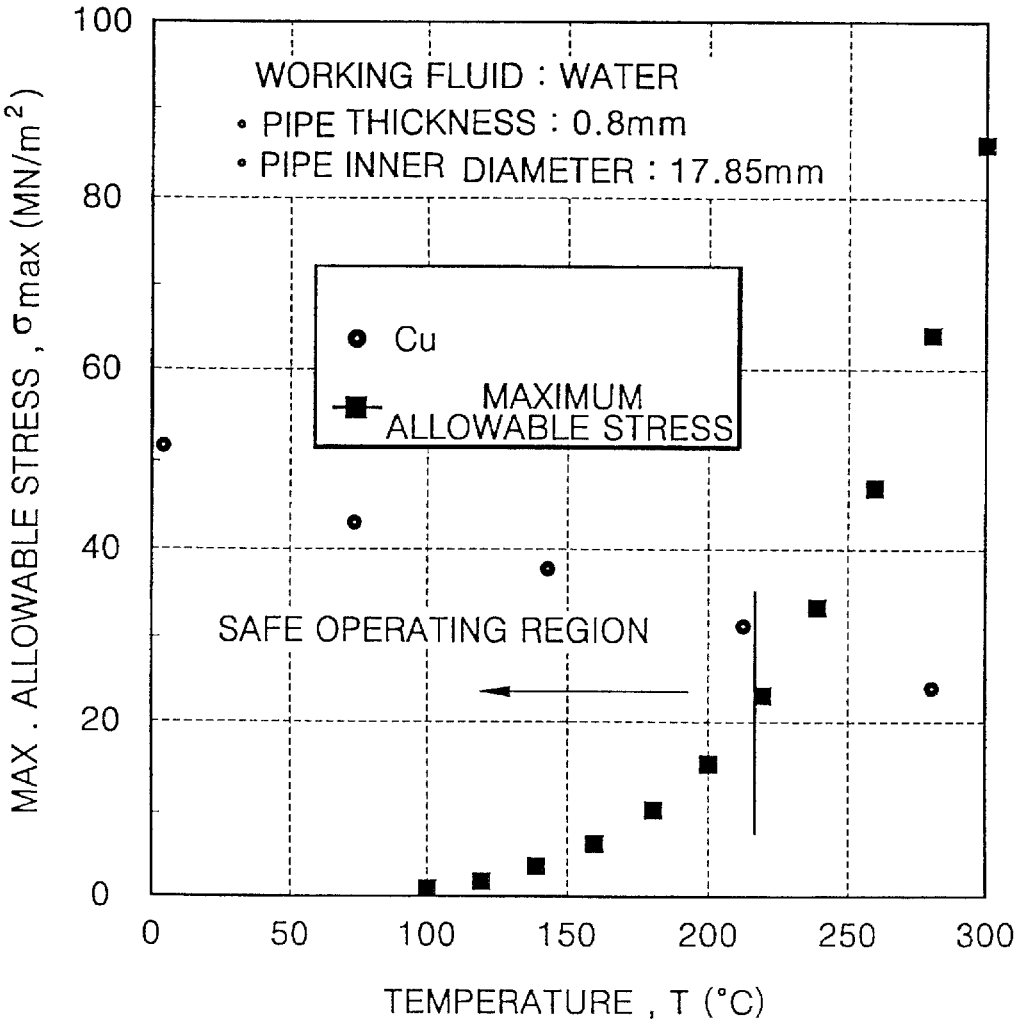

FIG. 18 is a graph of the ultimate tensile strength variations for a variety of heat pipe materials as a function of temperature variations for three different constructions of fusing rollers made with heat pipes of aluminum (Al), copper (Cr) and 304 stainless steel (SS304), taken over a temperature range extending between approximately 0° C. and approximately 500° C. FIG. 19A is a graph showing the maximum allowable stress and variations of maximum stress acting upon the heat pipe wall with respect to temperature variations when FC-40 is used as a working fluid for heat pipes constructed of aluminum, copper and 304 stainless steel. FIG. 19B is a graph of variations of maximum stress acting upon a copper heat pipe wall with respect to temperature variations when distilled water is used as a working fluid over a temperature range extending between approximately 0° C. and approximately 500° C., for heat pipes constructed of aluminum, copper and 304 stainless steel. As shown in FIG. 19A, the maximum allowable stress of the stainless steel (SS304) is much greater than that of either copper or aluminum. Safe operation without leakage of the working fluid is ensured for a heat pipe and end caps constructed of stainless steel (SS304) up to a working temperature of about 400° C.

Figure 20A:
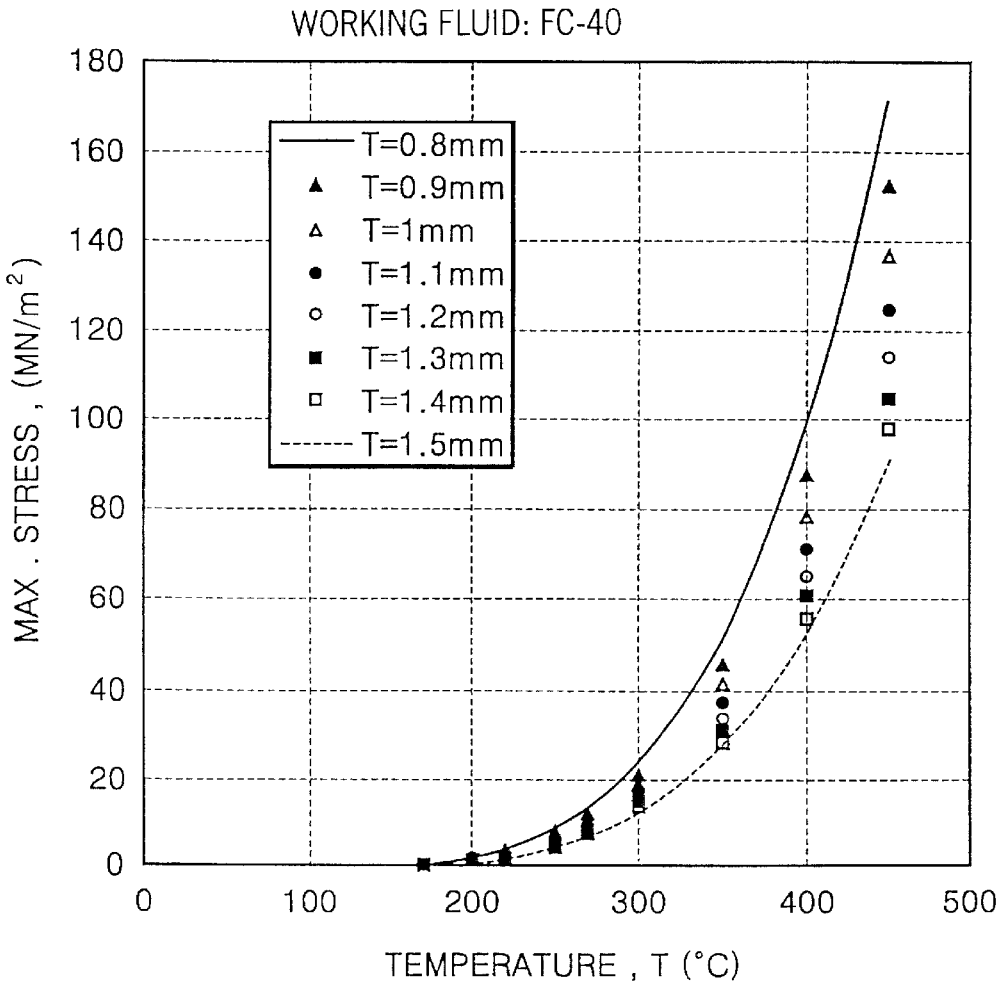
FIGS. 20A and 20B are graphs illustrating the maximum stress variations with respect to the heat pipe thickness (T) variations when FC-40 and distilled water are respectively used as a working fluid.
Figure 20B:
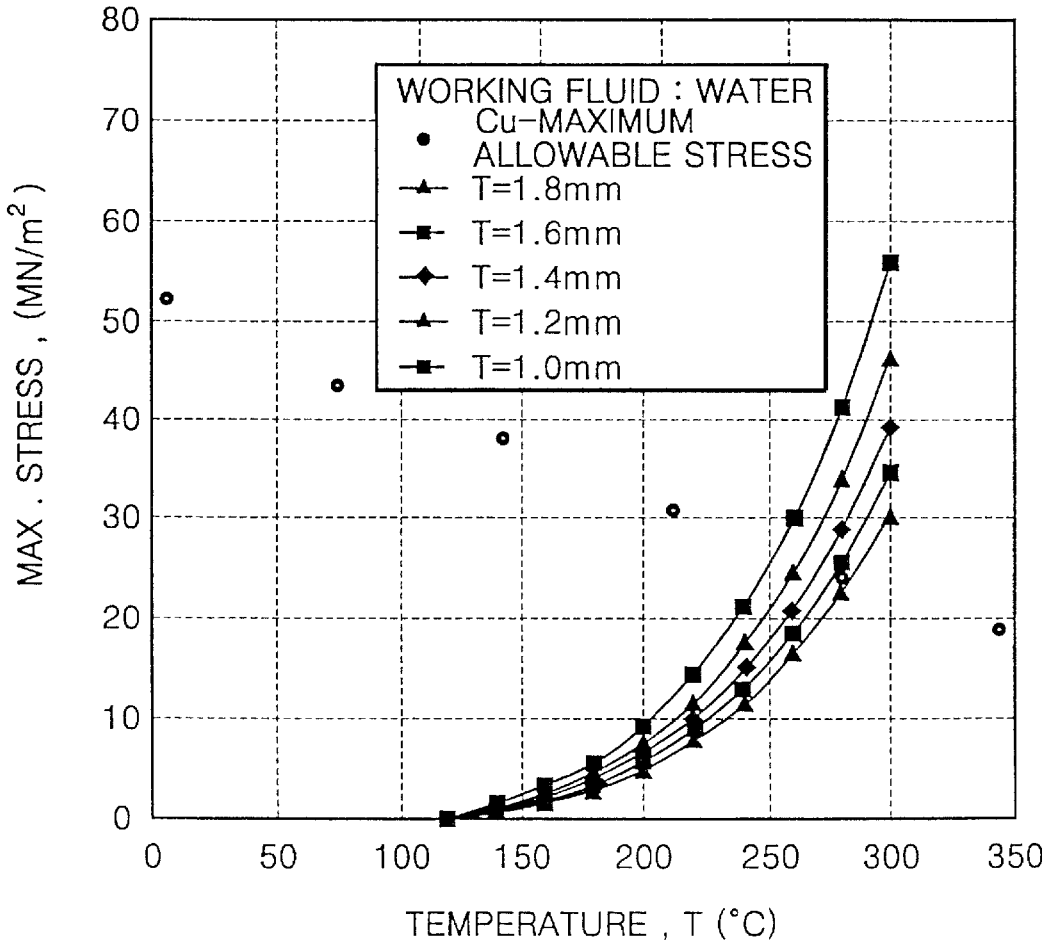

FIGS. 20A and 20B are graphs that illustrate variations in the maximum stress acting upon a copper heat pipe with respect to pipe thickness variations when FC-10 and distilled water are used as a working fluid, respectively over a temperature range that extends from more than 150° C. to less than 500° C. As shown in FIGS. 20A and 20B, although the thickness of the heat pipe varies from 0.8 mm up to 1.5 mm for FC-10 used as a working fluid, and from 1.0 mm up to 1.8 mm for distilled water used as a working fluid, respectively, the maximum stress acting upon the heat pipe does not change very much at an operating temperature greater than approximately 165° C., but less than 200° C.

Figure 21:
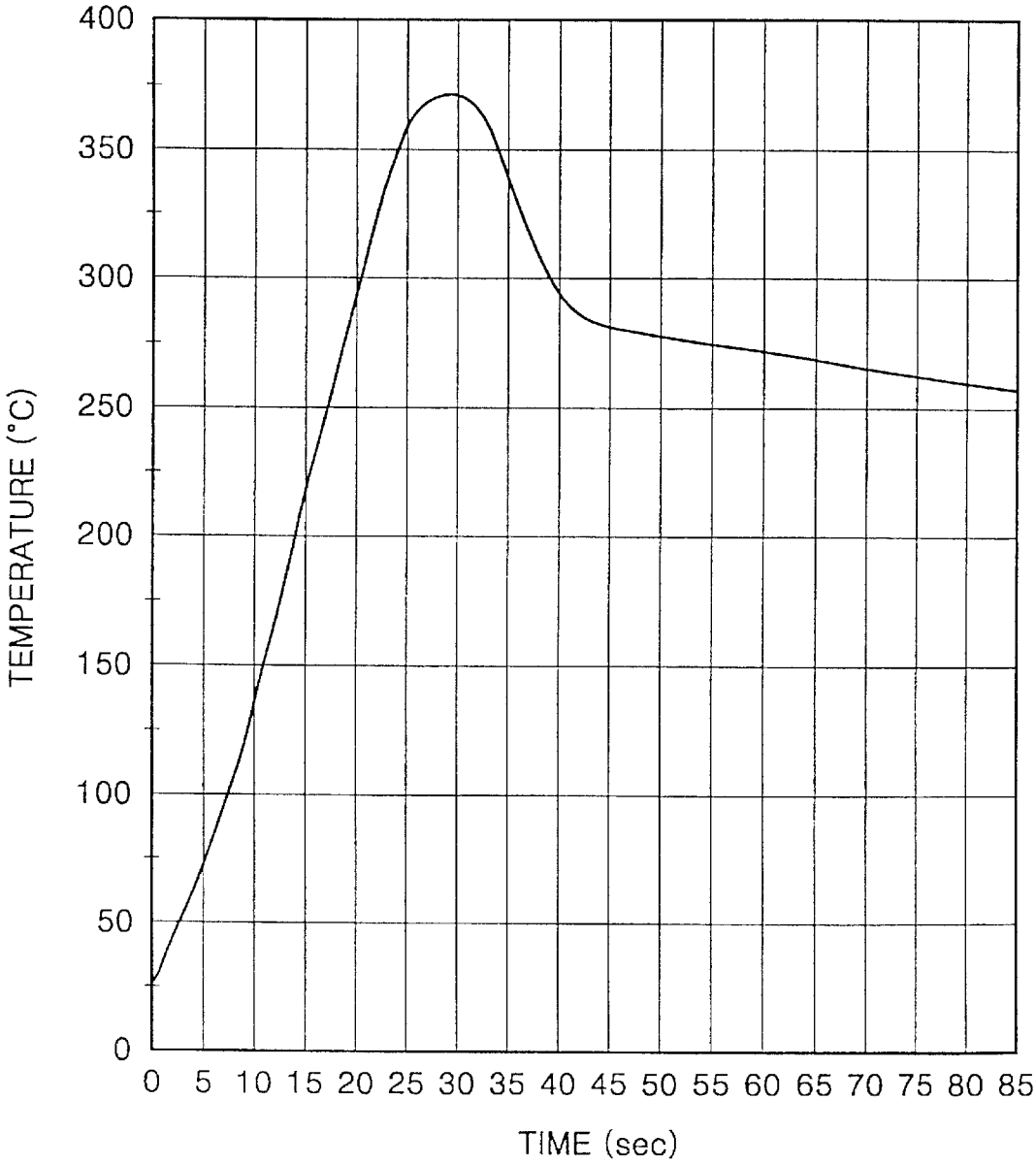
FIGS. 21 and 22 are graphs illustrating the temperature variations in the middle of the fusing roller with respect to time for the first embodiment of the fusing roller apparatus described above.
Figure 22:
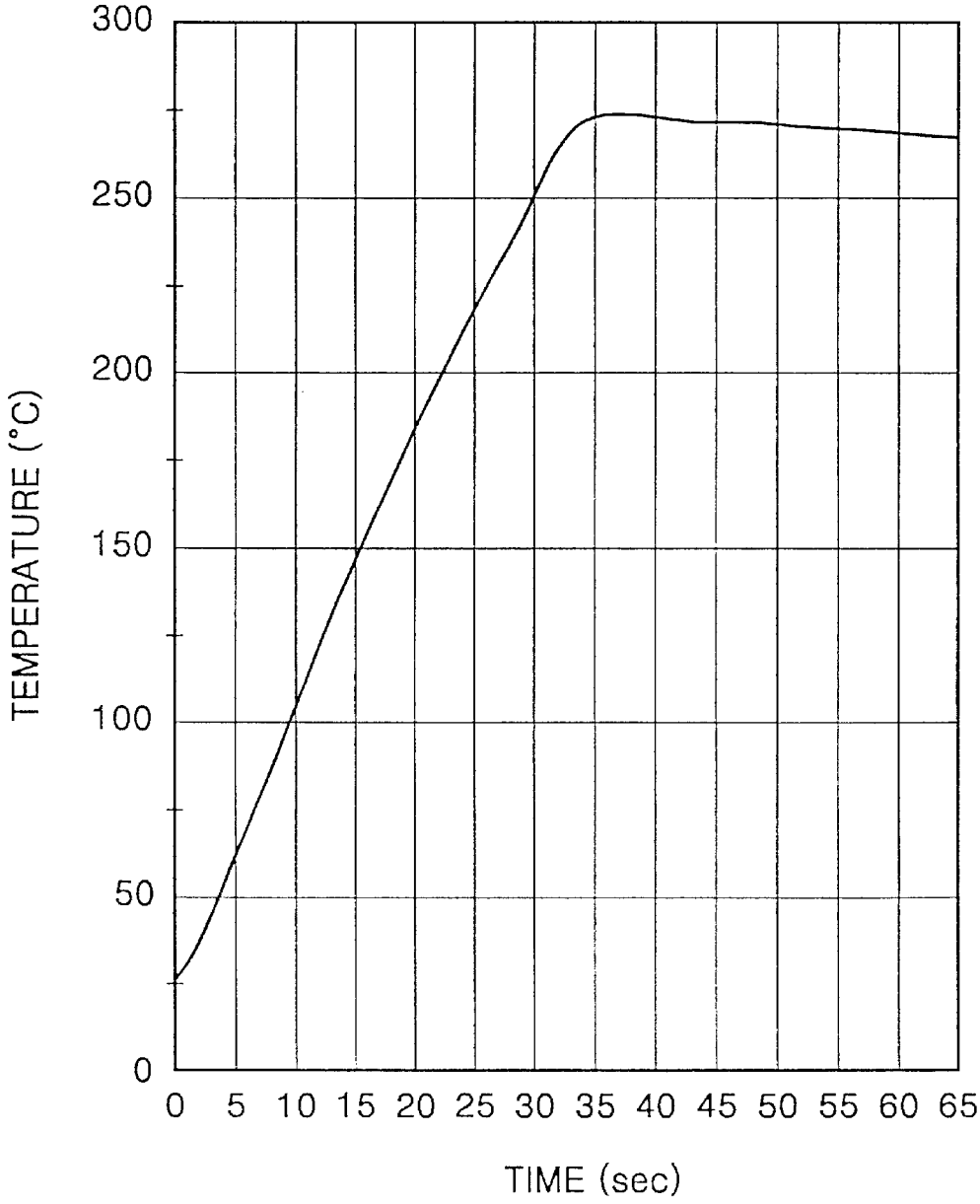

FIGS. 21 and 22 are graphs of the temperature variations (over a range between 0° C. and 400° C.) measured in the middle of the fusing roller with respect to time (over a period between zero and sixty-five seconds) for the first embodiment of the fusing roller apparatus described above. The fusing roller apparatus had a fusing roller made of copper and contains distilled water as a working fluid. The fusing roller had a thickness of 1.0 mm, an outer diameter of 17.85 mm, and a length of 258 mm. This test was performed at a fusing roller rotation rate of 47 rpm with a spiral resistance heating coil resistance of 32 Ω, a voltage of 200 V, and an instantaneous maximum power consumption of about 1.5 kW. The spiral resistance heating coil was in direct contact with the inner cylindrical surface of the fusing roller.

FIG. 21 shows measurements for a fusing roller apparatus containing distilled water as a working fluid that occupies 10% of the inner volume of the fusing roller. FIG. 22 shows measurements for a fusing roller apparatus containing distilled water occupying 30% of the volume of the fusing roller. Referring to FIG. 21, this prototype takes about 8 to 12 seconds to raise the temperature of the fusing roller from room temperature of about 22° C. to an operating temperature of about 175° C. and less than 14 seconds to reach 200° C . Referring to FIG. 22, it takes about 13 seconds to raise the temperature of the fusing roller from room temperature of about 22° C. to 175° C. and only about 22 seconds to 200° C.

Comparing the results of FIGS. 21 and 22, it is apparent that the rate of temperature increase varies depending on the volume ratio of working fluid contained in the sealed interior of the fusing roller. According to the results of experiments performed under various conditions, the fusing roller is operable with an amount of working fluid occupying 5–50% of the inner space of the fusing roller. The rate of temperature increase is high with only 5–15% of the volume of the fusing roller filled with working fluid.

Compared with a conventional image forming apparatus in terms of rate of temperature increase, for an image forming apparatus adopting one of the several possible designs for a fusing roller apparatus according to the present invention, there is no need to continuously supply power to the fusing roller apparatus during the stand-by state. Although the power is supplied when formation of an image starts, a fusing roller apparatus constructed according to the present invention can form an image, i.e., can still fuse a toner image, at a high speed, faster than contemporary equipment.

When the volume of the working fluid is more than 50% by volume, the rate of temperature increase becomes impractically slow. Meanwhile, if the volume of the working fluid is less than 5% by volume, a dry-out phenomenon either occurs or becomes likely to occur due to the insufficient supply of the working fluid, so that the fusing roller either does not function as well or does not function at all as a heat pipe.

In a fusing roller apparatus constructed according to the principles of the present invention, electrical power can be applied at a voltage of 90–240 volts and a frequency of 50–70 Hz, as well as at higher frequencies.

As described above, the fusing roller apparatus constructed according to the present invention includes a heating coil and a working fluid in the body of a metallic fusing roller having excellent conductivity, so that the surface of the fusing roller can be instantaneously heated up to a target fusing temperature to fix toner images that have been transferred to a print paper. Compared with a conventional halogen lamp type or direct surface heating type fusing roller apparatus using a palladium (Pd), ruthenium (Ru) or carbon (C) based heater, the fusing roller of the present invention can reach a target fusing temperature within a shorter period of time with reduced power consumption and the surface temperature of the fusing roller can be uniformly maintained. The fusing roller apparatus of the present invention needs neither a warm-up period nor a stand-by period, and thus any image forming apparatus, such as a printer, copy machine, or facsimile, equipped with the fusing roller apparatus of the present invention, does not need to supply power to the fusing roller to ready for printing. Thus, overall power consumption of the image forming apparatus is reduced. In addition, the fusing roller apparatus of the present invention is based on the principle of a heat pipe, so that the temperature distribution in the longitudinal direction of the fusing roller can be uniformly controlled, thereby optimally improving toner fusing characteristics.

In addition, the fusing roller apparatus of the present invention can be easily manufactured on a mass scale, and ensure safe operation. The parts of the fusing roller apparatus are compatible with other commercially available parts. The quality of the fusing roller apparatus can be easily controlled. A high-speed printer can be implemented with the fusing roller apparatus according to the present invention.

The fusing roller apparatus and the method for manufacturing the fusing roller apparatus according to the present invention provide the following advantages.

First, the fusing roller apparatus can be manufactured by simple automated processes.

Second, the temperature variations in the axial, or longitudinal direction of the heat pipe are small (within the range of ±1°).

Third, a high-speed printer can be easily implemented with the fusing roller apparatus.

Fourth, the heat source and the heat pipe, which are the main elements of the fusing roller apparatus, are formed as separate units, so that the fusing roller apparatus can be easily manufactured on mass scale and ensures safe operation. The parts of the fusing roller apparatus are compatible with other commercially available parts. The quality of the fusing roller apparatus can be easily controlled.

Fifth, due to continuous vaporization and condensation cycles of the working fluid contained in the sealed heat pipe, although the pressure inside the heat pipe increases at a high temperature (one atmosphere or less at 165° C. for FC40), the risk of explosion or serious deformation is very low.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A fusing roller apparatus, comprising:

a cylindrical fusing roller having axially opposite ends forming an interior cavity that is sealed and evacuated down to a predetermined pressure;

a heat generator installed within said interior cavity between said ends, with said heat generator being in direct physical contact with said fusing roller over an axial length of an interior cylindrical surface of said fusing roller; and a working fluid contained in the fusing roller in direct physical contact with said heat generator.

2. The fusing roller apparatus of claim 1, wherein said heat-generator comprises a resistance heating coil spirally wound within said interior cavity with axially opposite ends of the resistance heating coil extending out from said fusing roller through different said ends of said fusing roller.

3. The fusing roller apparatus of claim 2, wherein the heat-generator has an outer diameter greater than the inner diameter of the fusing roller and the heat-generator contacts an interior cylindrical wall of the fusing roller with a force.

4. The fusing roller apparatus of claim 1, wherein the heat-generator has an outer diameter greater than the inner diameter of the fusing roller and the heat-generator contacts an interior cylindrical wall of the fusing roller with a force.

5. The fusing roller apparatus of claim 1, wherein the fusing roller is formed of copper.

6. The fusing roller apparatus of claim 1, wherein the fusing roller is formed of stainless steel.

7. The fusing roller apparatus of claim 1, wherein the working fluid is distilled water.

8. The fusing roller apparatus of claim 1, wherein an amount of said working fluid contained within said fusing roller is in the range of 5–50% by volume of said interior cavity.

9. The fusing roller apparatus of claim 1, wherein an amount of said working fluid contained within said fusing roller is in the range of 5–15% by volume of said interior cavity.

10. A fusing roller apparatus, comprising:

a cylindrical fusing roller having axially opposite ends forming an interior cavity that is sealed and evacuated down to a predetermined pressure;

a heat generator installed within said interior cavity between said ends, with said heat generator being in direct physical contact with said fusing roller over an axial length of an interior cylindrical surface of said fusing roller;

a working fluid contained in the fusing roller in direct physical contact with said heat generator; and a partition dividing said interior cavity into a plurality of unit spaces.

11. The fusing roller apparatus of claim 10, wherein said heat-generator comprises a resistance heating coil spirally wound within said interior cavity with axially opposite ends of the resistance heating coil extending out from said fusing roller through different said ends of said fusing roller.

12. The fusing roller apparatus of claim 10, wherein said partition comprises a plurality of radially extending webs.

13. The fusing roller apparatus of claim 10, wherein the heat-generator has an outer diameter greater than the inner diameter of the fusing roller and the heat-generator contacts an interior cylindrical wall of the fusing roller with a force.

14. The fusing roller apparatus of claim 10, wherein the fusing roller is formed of copper.

15. The fusing roller apparatus of claim 10, wherein the fusing roller is formed of stainless steel.

16. The fusing roller apparatus of claim 10, wherein the working fluid is distilled water.

17. The fusing roller apparatus of claim 10, wherein an amount of said working fluid contained within said fusing roller is in the range of 5–50% by volume of said interior cavity.

18. The fusing roller apparatus of claim 10, wherein an amount of said working fluid contained within said fusing roller is in the range of 5–15% by volume of said interior cavity.

19. A fusing roller apparatus, comprising:

a cylindrical fusing roller including an outer tube having an interior first diameter and an inner tube having an exterior second diameter smaller than the first diameter, forming an annular space between said outer tube and said inner tube, said annular space being evacuated down to a predetermined pressure;

a heat-generator installed inside said annular space; and a working fluid contained within said annular space having a quantity less than a volume of said annular space.

20. The fusing roller apparatus of claim 19, wherein the heat-generator comprises a first heater installed in said annular space in direct physical contact with said outer tube.

21. The fusing roller apparatus of claim 20, wherein the first heater is a resistance heating coil spirally wound within said annular space.

22. The fusing roller apparatus of claim 20, wherein the first heater is arranged along and in direct physical contact with an inner cylindrical surface of the outer tube.

23. The fusing roller apparatus of claim 19, wherein said heat-generator comprises a first heater installed in said annular space and a second heater installed inside said inner tube.

24. The fusing roller apparatus of claim 23, wherein said first heater comprises a spirally wound resistance heating coil and said second heater comprises a halogen lamp.

25. The fusing roller apparatus of claim 19, wherein the inner tube and the outer tube are formed of copper.

26. The fusing roller apparatus of claim 19, wherein the inner tube and the outer tube are formed of stainless steel.

27. The fusing roller apparatus of claim 19, wherein the working fluid is distilled water.

28. The fusing roller apparatus of claim 19, wherein said quantity of working fluid contained within said fusing roller is in the range of 5–50% by volume of said volume of said annular space.

29. The fusing roller apparatus of claim 19, wherein said quantity of working fluid contained within said fusing roller is in the range of 5–15% by volume of said volume of said annular space.

30. The fusing roller apparatus of claim 19, further comprising a plurality of partitions dividing said annular space into a plurality of unit spaces.

31. A fusing roller apparatus, comprising:

a cylindrical fusing roller having axially opposite ends sealed to form an interior cavity that is evacuated to a predetermined pressure;

a heat-generator installed within said interior cavity of said fusing roller and helically wound in direct physical contact against an inner cylindrical wall of said fusing roller;

a quantity of a working fluid contained within said interior cavity;

a protective layer coated on an exterior cylindrical surface of the fusing roller, said protective layer easily releasing toner images; and an electrode coupled to said heat generator enabling application of a voltage across said heat-generator.

32. The fusing roller apparatus of claim 31, wherein the heat-generator is a resistance heating coil.

33. The fusing roller apparatus of claim 32, wherein a surface of the resistance heating coil is coated with a protective layer.

34. The fusing roller apparatus of claim 33, wherein the protective layer coating the resistance heating coil is formed of magnesium oxide.

35. The fusing roller apparatus of claim 31, wherein the voltage applied to the heat-generator is in the range of 90–240 volts.

36. The fusing roller apparatus of claim 31, wherein the voltage applied to the heat-generator has a frequency of 50–70 Hz.

37. A process of manufacturing a fusing roller assembly, comprising:

forming a cylindrical fusing roller with an interior cavity extending axially between axially opposite bases of said roller;

inserting a heating coil wound in a helical spiral into said interior cavity;

evacuating said interior cavity;

partially filling said interior cavity with a working fluid; and sealing said interior cavity while preserving electrical connectivity across said heating coil.

38. The process of claim 37, further comprising:

forming said fusing roller with said interior cavity exhibiting an interior first diameter;

winding said heating coil to exhibit an exterior second diameter greater than said first diameter before insertion of said heating coil into said interior cavity;

reducing said second diameter during said insertion; and releasing said heating coil to assure said second diameter after said insertion.

39. The process of claim 37, further comprised of placing an inner tube within said interior cavity, with said heating coil positioned between said fusing roller and said inner tube.

40. The process of claim 37, further comprised of dividing said interior cavity into a plurality of sectors each containing a quantity of said working fluid.

41. A fusing roller apparatus, comprising:

a cylindrical fusing roller having axially opposite ends sealed to form an interior cavity that is evacuated to a predetermined pressure;

a first heat-generator disposed within said interior cavity of said fusing roller and being helically wound and in direct physical contact against an inner cylindrical wall of said fusing roller; and a quantity of a working fluid contained within said interior cavity.

42. The fusing roller apparatus of claim 41, said working fluid being in direct physical contact with said first heat-generator.

43. The fusing roller apparatus of claim 41, said working fluid being physically separated from said first heat-generator.

44. The fusing roller apparatus of claim 41, said first heat-generator being a resistive heater.

45. The fusing roller apparatus of claim 42, said apparatus further comprising an inner tube disposed within said interior cavity, said working fluid being located only within said interior cavity and outside said inner tube.

46. The fusing roller apparatus of claim 45, a second heat-generator being disposed within said inner tube, said second heat-generator not being in contact with said working fluid.

47. The fusing roller apparatus of claim 45, a space between said interior cavity and said inner tube being partitioned off into a plurality of partitions preventing working fluid between two adjacent partitions from contacting working fluid between another two adjacent partitions.

48. The fusing roller apparatus of claim 42, said interior cavity having a plurality of partitions, each of said plurality of partitions having a plurality of openings enabling working fluid between two adjacent partitions to mix freely with working fluid between another two adjacent partitions within said interior cavity.

* * * * *